US006668564B2

(12) United States Patent
Saikusa et al.

(10) Patent No.: US 6,668,564 B2
(45) Date of Patent: Dec. 30, 2003

(54) REFRIGERATION CYCLE

(75) Inventors: Tetsuji Saikusa, Tokyo (JP); Hiroyuki Odagi, Tokyo (JP); Naoki Tanaka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/061,275

(22) Filed: Feb. 4, 2002

(65) Prior Publication Data

US 2002/0129612 A1 Sep. 19, 2002

(30) Foreign Application Priority Data

Mar. 16, 2001 (JP) ..... 2001-075872

(51) Int. Cl.[7] ..... F25B 31/00; F25B 43/02
(52) U.S. Cl. ..... 62/84; 62/192
(58) Field of Search ..... 62/192, 84, 228.3, 62/228.1, 509, 468, 473

(56) References Cited

U.S. PATENT DOCUMENTS 4,829,786 A * 5/1989 Sand et al. ..... 62/468
5,230,222 A * 7/1993 Erbs ..... 62/192
5,953,934 A * 9/1999 Makino et al. ..... 62/470
5,959,428 A * 9/1999 Saito et al. ..... 318/705
6,197,211 B1 * 3/2001 Nakajima et al. ..... 252/68
6,330,811 B1 * 12/2001 Arman et al. ..... 62/643
6,374,629 B1 * 4/2002 Oberle et al. ..... 62/473

FOREIGN PATENT DOCUMENTS

| | | |
|---|---|---|
| JP | 8-145483 | 6/1996 |
| JP | 10-259960 | 9/1998 |
| JP | 11-257805 | 9/1999 |

* cited by examiner

*Primary Examiner*—Marc Norman
(74) *Attorney, Agent, or Firm*—Oblon, Spivak, McClelland, Maier & Neustadt, P.C.

(57) ABSTRACT

A highly reliable refrigeration cycle having a residual refrigerant, which is designed that the refrigerating machine oil does not stagnate in the refrigeration cycle after flowing out from the compressor even if the refrigerating machine oil is weakly soluble in a refrigerant. Thus, the compressor may be prevented from the exhaustion of oil. In addition to that, even if the accumulator is removed from the cycle, a large amount of wet vapor suction into the compressor may also be avoided. A control section is provided for controlling saturated oil solubility in a liquid refrigerant in the refrigeration cycle. The control section includes a receiver and first and second flow regulators which are placed before and after, respectively, the receiver. A residual liquid refrigerant obtaining in the circulation of a refrigerant is reserved in the receiver at a high temperature so that the weakly soluble refrigerating machine oil is prevented from separating.

25 Claims, 27 Drawing Sheets

REFRIGERATION CYCLE

BACKGROUND OF THE INVENTION

1. Field of the Invention

The present invention relates to a refrigeration cycle for such as an air conditioner.

2. Description of the Related Art

FIG. 26 is a block diagram illustrating a conventional refrigeration cycle for an air conditioner. With referring to the figure, a reference numeral 1 denotes a compressor, which sucks in a low-temperature and low-pressure gas refrigerant in an accumulator 6, compresses the gas refrigerant, and discharges a high-temperature and high-pressure gas refrigerant. A reference numeral 2 denotes a four-way valve. Reference numerals 3*a,* 3*b,* 3*c* denote indoor heat exchangers. Reference numerals 4*a,* 4*b,* 4*c* denote flow regulators. A reference numeral 5 denotes an outdoor heat exchanger. A reference numeral 6 denotes the accumulator.

According to the thus configured conventional refrigeration cycle for an air conditioner, a high-temperature and high-pressure gas refrigerant is discharged from the compressor 1 and then enters the outdoor heat exchanger 5 through the four-way valve 2 in a cooling operation, for example. This gas refrigerant is heat-exchanged with outside air by the outdoor heat exchanger 5 to become a liquefied refrigerant. Then the liquefied refrigerant diverges and depressurized through the flow regulators 4*a,* 4*b,* 4*c* to become a low dried two-phase refrigerant, and enters the respective indoor heat exchangers 3*a,* 3*b,* 3*c*. Then, the two-phase refrigerant is heat-exchanged with room air to evaporate to become a highly dried two-phase refrigerant. This two-phase refrigerant enters the accumulator 6 through the four-way valve 2. The gas refrigerant in the accumulator 6 is sucked in again by the compressor 1, at which time residual refrigerant is reserved in the accumulator 6.

Such a conventional refrigeration cycle as mentioned above is provided with the accumulator 6 for reserving residual refrigerant between the suction inlet side of the compressor 1 and the four-way valve 2. Under the condition that the refrigeration cycle is operating, the temperature of the liquid refrigerant in the accumulator 6 is equivalent to a saturation temperature corresponding to the suction pressure of the compressor 1, which is a low temperature of five degrees centigrade or below in a normal state of use. However, if using such refrigerating machine oil which can be weakly dissolved in a refrigerant as alkyl-benzene oil, for example, in the conventional refrigeration cycle, the saturation solubility of the refrigerating machine oil of a liquid refrigerant in the accumulator at a low temperature becomes a maximum of 0.5% or below. The liquid refrigerant is reserved at a temperature as low as or lower than five degrees centigrade as shown in FIG. 27. Thus, the saturation solubility is lower than 0.8% which is an oil circulation rate in the refrigeration cycle of a general air conditioner. As a result, the refrigerating machine oil is separated in two layers, and the refrigerating machine oil having a smaller specific gravity than that of a liquid refrigerant floats on the surface of the liquid refrigerant. However, according to the conventional refrigeration cycle, the oil return port of the accumulator 6 is provided at a lower level of a pipe in the accumulator. For that reason, the refrigerating machine oil is not allowed to return to the compressor from the accumulator, thereby stagnating in the accumulator. As a result, refrigerating machine oil in the compressor dries up, which may cause a problem of damaging the compressor or the like.

SUMMARY OF THE INVENTION

It is an object of the present invention to provide a highly reliable refrigeration cycle having residual refrigerant. According to this refrigeration cycle, it is designed that the refrigerating machine oil does not stagnate in the refrigeration cycle after flowing out from the compressor if the refrigerating machine oil is weakly soluble in a refrigerant. Thus, the compressor may be prevented from the exhaustion of the oil. In addition to that, even if the accumulator is removed from the cycle, a large amount of wet vapor suction into the compressor may also be avoided.

These and other objects of the embodiments of the present invention are accomplished by the present invention as hereinafter described in further detail.

According to one aspect of the present invention, a refrigeration cycle, which connects with a compressor, an outdoor heat exchanger, a flow regulator and an indoor heat exchanger by pipes to form a loop, and contains refrigerating machine oil and a refrigerant, may include a control section. The control section may control a saturation solubility of the refrigerating machine oil of a liquid refrigerant reserved in the refrigeration cycle so that the saturation solubility does not become lower than an oil circulation rate of the refrigerating machine oil in the refrigeration cycle.

The refrigerating machine oil may be weakly soluble in the refrigerant.

The control section may include a receiver and at least one of a first flow regulator and a second flow regulator. The receiver may be placed between the outdoor heat exchanger and the indoor heat exchanger. The receiver may reserve a residual refrigerant. The first flow regulator may be provided between the pipes which are connected, respectively, with the receiver and the outdoor heat exchanger. The second flow regulator may be provided between the pipes which are connected, respectively, with the receiver and the indoor heat exchanger.

The refrigeration cycle may further include an operating time counter for counting an operating period of the compressor. Then, the compressor may be controlled so as to change an operation frequency to a given preset operation frequency and then operate for a given period whenever the operating period of the compressor obtained from the operating time counter exceeds a given preset period.

The refrigeration cycle may further include a start controller for operating the compressor with a given preset operation frequency, which is lower than a normal operation frequency, for a given period when an operation of the refrigeration cycle is started.

The refrigeration cycle may further include a heater for heating the compressor.

In the refrigeration cycle, one of an HRC refrigerant and an HC refrigerant may be used as the refrigerant.

In the refrigeration cycle, alkyl-benzene oil may be used as the refrigerating machine oil.

According to another aspect of the present invention, a method for controlling a refrigeration cycle which connects with a compressor, an outdoor heat exchanger, a flow regulator and an indoor heat exchanger by pipes to form a loop and contains refrigerating machine oil and a refrigerant, may include the step of controlling a saturation solubility of the refrigerating machine oil of a liquid refrigerant reserved in the refrigeration cycle so that the saturation solubility does not become lower than an oil circulation rate of the refrigerating machine oil in the refrigeration cycle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
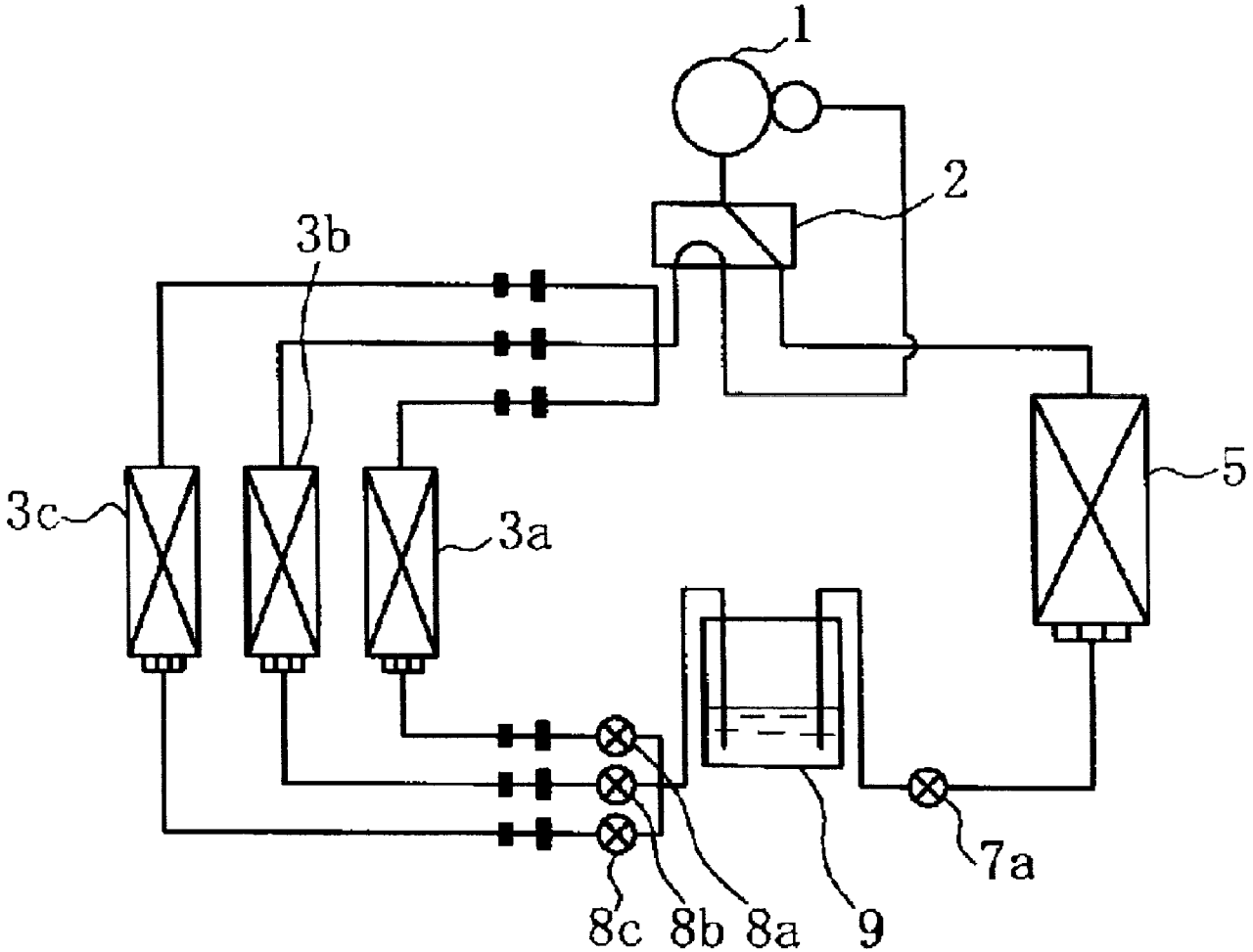
FIG. 1 is a block diagram of a refrigeration cycle for an air conditioner according to a first embodiment of the present invention.

Reference will now be made in detail to the present preferred embodiments of the invention, examples of which are illustrated in the accompanying drawings, wherein like reference numerals indicate like elements through out the several views.

Embodiment 1

Figure 2:
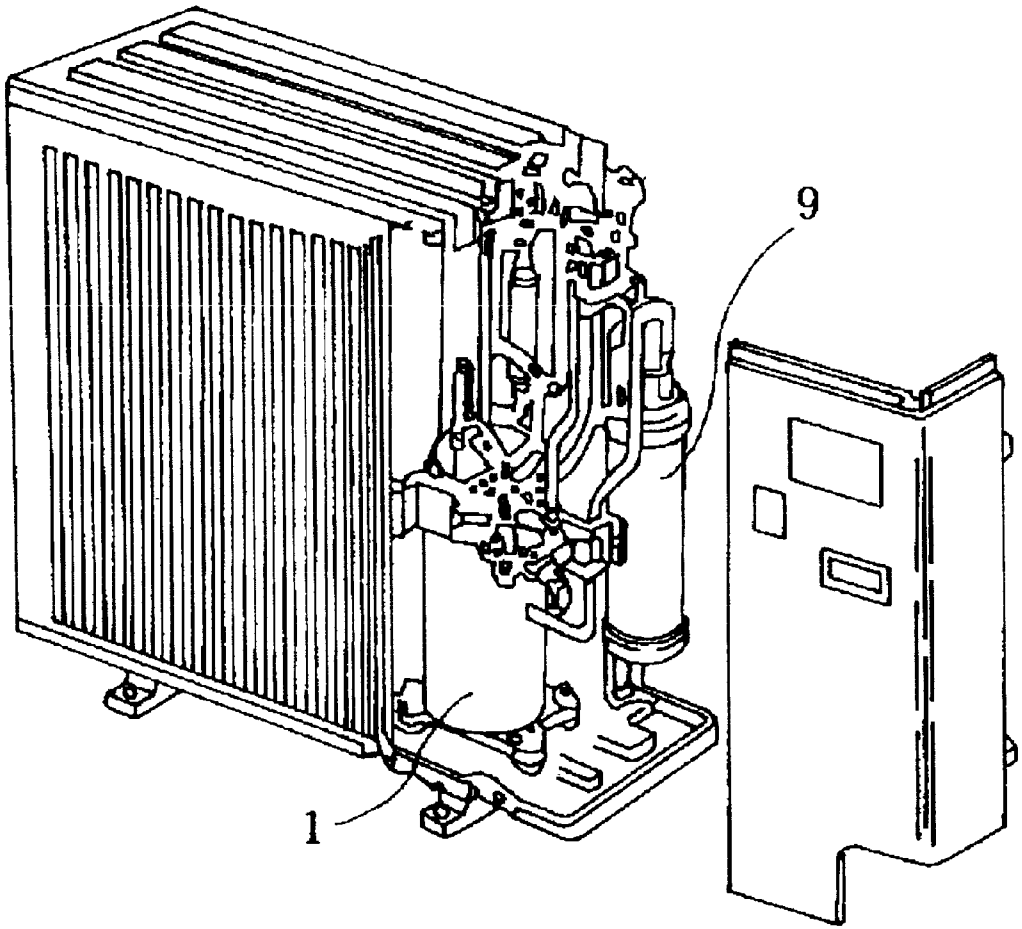
FIG. 2 is a perspective view of the air conditioner according to the first embodiment of the present invention.
Figure 26:
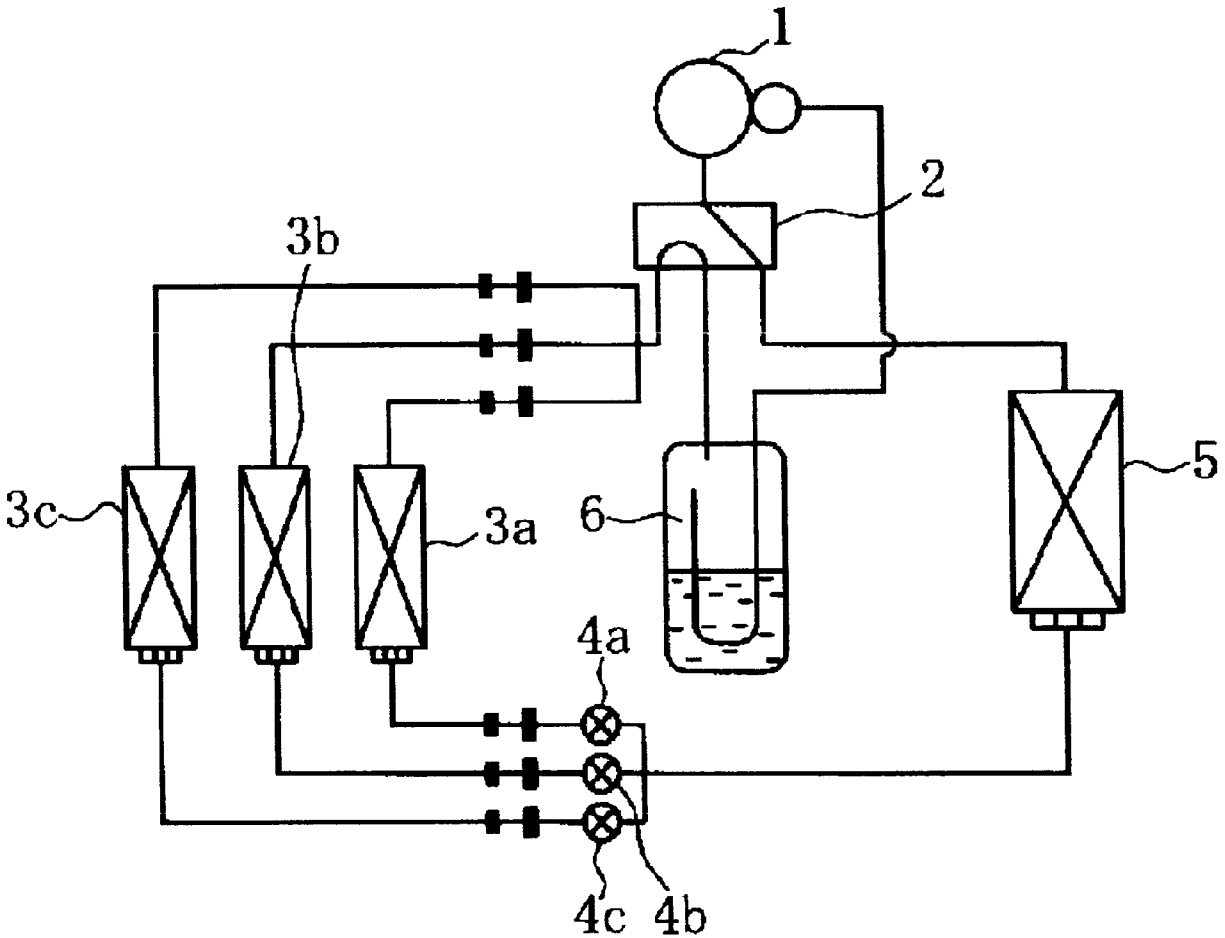
Fig. 26 CONVENTIONAL ART
FIG. 26 is a block diagram of a conventional refrigeration cycle for an air conditioner.

FIG. 1 shows a block diagram of a refrigeration cycle for an air conditioner, for example, according to a first embodiment of the present invention. FIG. 2 is a perspective view of the configuration of the unit of the air conditioner according to the first embodiment. FIG. 1 shows the refrigeration cycle in a cooling operation. The elements of the refrigeration cycle in FIG. 1 which are the same as or equivalent to the elements of the conventional refrigeration cycle discussed with reference to FIG. 26 are assigned the same reference numerals or signs, and will not be discussed here.

With referring to FIG. 1, a reference numeral 7*a* denotes a first flow regulator (a throttle unit or a throttle device), which is provided on a pipe connecting an outdoor heat exchanger 5 and a receiver 9 which will be discussed later. Reference numerals 8*a*, 8*b*, 8*c* denote second flow regulators, which are provided, respectively, on pipes connecting indoor heat exchangers 3*a*, 3*b*, 3*c* and the receiver 9. The receiver 9 is provided at the back of a compressor 1 as illustrated in FIG. 2. There are two pipes reaching the bottom of the receiver 9 through the top, one being extended from the side of the first flow regulator 7*a* and the other being extended from the side of the second flow regulators 8*a*, 8*b*, 8*c*.

Figure 3:
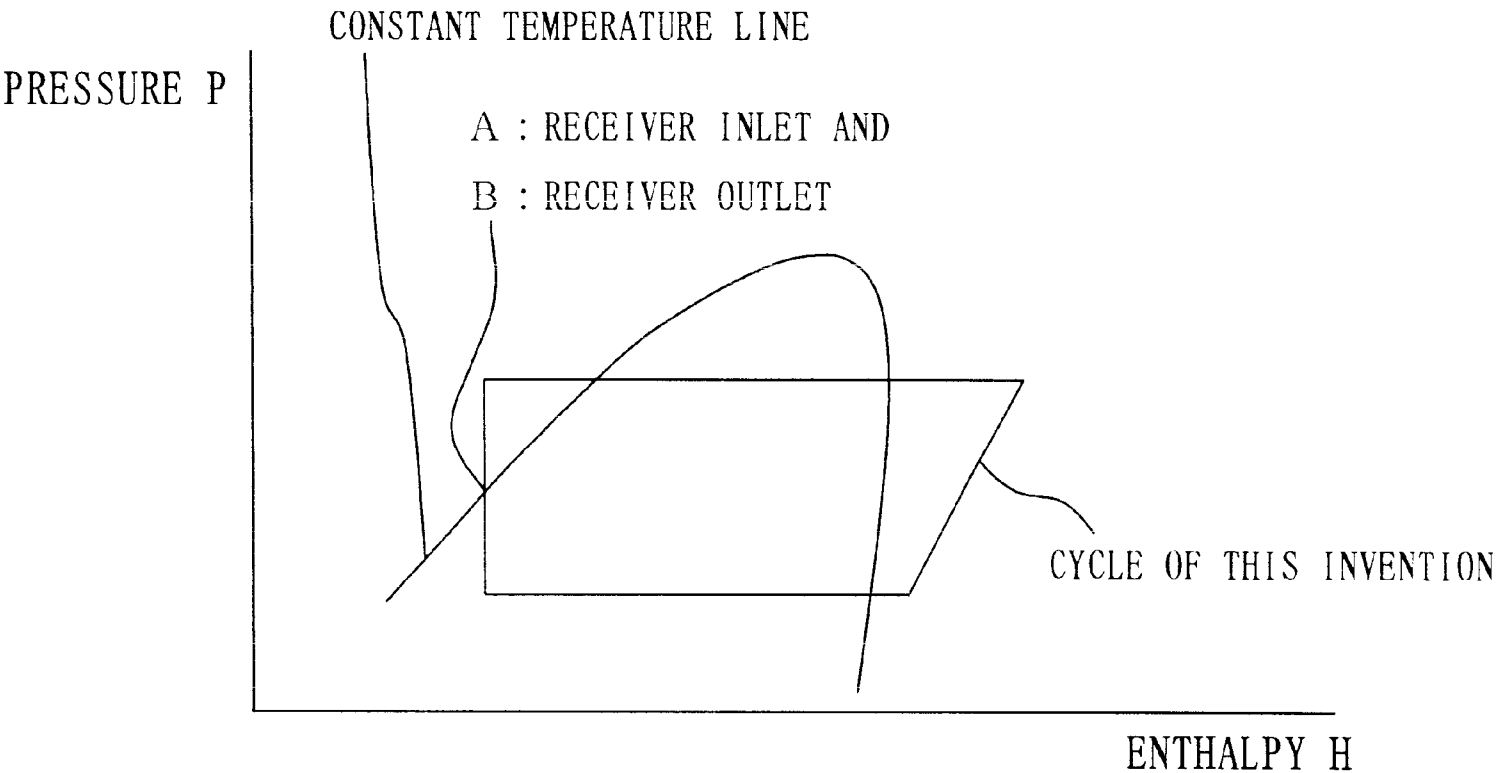
FIG. 3 is a Mollier diagram of the refrigeration cycle in a cooling operation according to the first embodiment of the present invention.

Now, a cooling operation of the thus configured refrigeration cycle is discussed with reference to FIG. 3. FIG. 3 is a Mollier diagram illustrating the cooling operation with a graph of enthalpy H on the horizontal axis versus pressure P on the vertical axis.

A high-temperature and high-pressure gas refrigerant is discharged from the compressor 1, and then enters the outdoor heat exchanger 5 through a four-way valve 2. This gas refrigerant is heat-exchanged with outside air by the outside heat exchanger 5 to become a liquid refrigerant, and then enters the first flow regulator 7*a*. This refrigerant entering the first flow regulator 7*a* is decompressed to a level indicated by "A" in FIG. 3 to become a saturated liquid refrigerant in an intermediate-pressure, and then enters the receiver 9. The intermediate-pressure saturated liquid refrigerant entering the receiver 9 flows out from the receiver 9 with a level indicated by "B" in the figure. The liquid refrigerant then passes through the second flow regulators 8*a,* 8*b,* 8*c* to become a low-temperature and low-pressure two-phase refrigerant with a dryness quality between 0.2 and 0.3, and then enters the indoor heat exchangers 3*a,* 3*b,* 3*c*. This low-temperature and low-pressure two-phase refrigerant is then heat-exchanged with room air by the indoor heat exchangers 3*a,* 3*b,* 3*c* to evaporate and become a low-temperature and low-pressure gas refrigerant. The gas refrigerant is then sucked in by the compressor 1 via the four-way valve 2. At this stage, a residual refrigerant remaining after the refrigerant circulation is reserved in the receiver 9 as a saturated liquid refrigerant.

Figure 27:
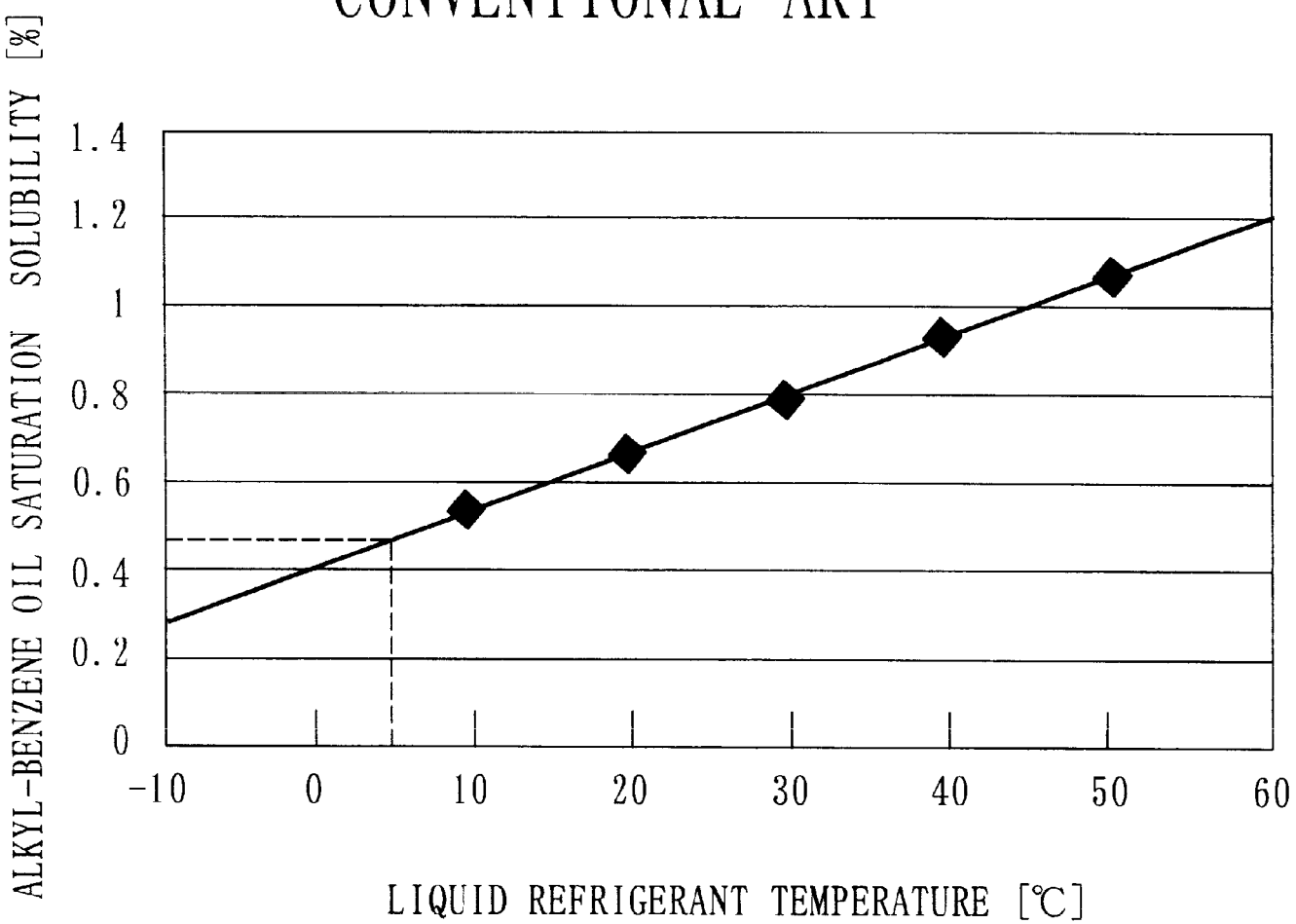
Fig. 27 CONVENTIONAL ART
FIG. 27 is a characteristic diagram illustrating saturation solubility of alkyl-benzene oil in a liquid refrigerant.

With referring to the receiver 9, the first flow regulator 7*a,* and the second flow regulators 8*a,* 8*b,* 8*c,* they function as a control section for controlling the solubility of saturated oil of the liquid refrigerant in the refrigeration cycle. The liquid refrigerant reserved in the receiver 9 is controlled by the first flow regulator 7*a* and the second flow regulators 8*a,* 8*b,* 8*c* so as to hold a saturation temperature as relatively high as 30 to 45 degrees centigrade. If using a type of refrigerating machine oil which is weakly soluble in a refrigerant, for example, the saturation solubility of the weakly soluble oil in the liquid refrigerant in the receiver becomes 0.8% or higher as aforementioned with reference to FIG. 27. In general, if an air conditioner is operated at an oil circulation rate of 0.8% or lower, weakly soluble oil in a residual refrigerant stays dissolved in the liquid refrigerant in the receiver 9, and is never separated in two layers. Still more, as an accumulator is not provided on the suction inlet side of the compressor, highly viscous and weakly soluble oil at a low temperature is trapped inside. Hence, the refrigerating machine oil will not be prevented from returning to the compressor.

Thus, according to the first embodiment, the receiver 9, the first flow regulator 7*a,* and the second flow regulators 8*a,* 8*b,* 8*c* are used to control the solubility of saturated oil of the liquid refrigerant in the refrigeration cycle. Then, the residual refrigerant remaining after the refrigerant circulation is designed to be reserved in the receiver 9 at a high temperature. As a result, the weakly soluble refrigerating machine oil stays dissolved in the liquid refrigerant in the receiver 9. Thus, the weakly soluble oil may be prevented from being separated to stagnate in the receiver 9. Still more, as an accumulator is not included, the refrigerating machine oil is allowed to return to the compressor without fail. Hence, the reliability of the refrigeration cycle may be enhanced.

Furthermore, the refrigeration cycle uses a type of oil which is weakly soluble as the refrigerating machine oil. The operation of the refrigeration cycle is the same as that discussed above, and will not be discussed here.

An effect of the refrigeration cycle of this embodiment may be summarized as follows. The weakly soluble oil, which is highly stable as the refrigerating machine oil, is used. As a result, in the case of replacing an existing air conditioner, existing extension pipes used in the existing air conditioner are allowed to be reused involving no replacement. Even if the existing air conditioner uses an HCFC refrigerant+mineral oil, the nature of the weakly soluble oil will not be affected to change by residual substances such as the mineral oil remaining in the existing pipes. Therefore, the reliability of equipment may be guaranteed. Thus, the refrigeration cycle has the merit of saving installation workload and reducing installation costs.

Furthermore, the same effect may be obtained if this refrigeration cycle is provided with a plurality of indoor heat exchangers. An effect of the refrigeration cycle of this case may be explained as follows. If the number of operating indoor units is small and an amount of remaining residual refrigerant is large, weakly soluble oil stays dissolved in the residual refrigerant in the receiver, therefore the weakly soluble oil is not separated in two layers to stagnate. Still more, as no accumulator is provided at the suction inlet side of the compressor, low-temperature and highly viscous weakly soluble oil is trapped inside. As a result, the oil is not prevented from returning to the compressor. Hence, the reliability of the refrigeration cycle may be enhanced.

Furthermore, according to the refrigeration cycle, the control section for controlling the saturated oil solubility includes the receiver and at least one of the first flow regulator, which is placed between the receiver and the outdoor heat exchanger, and the second flow regulators, which is placed between the receiver and the indoor heat exchangers. The operation and the effect of this refrigeration cycle are the same as those aforementioned, and will not be discussed here.

Embodiment 2

Figure 4:
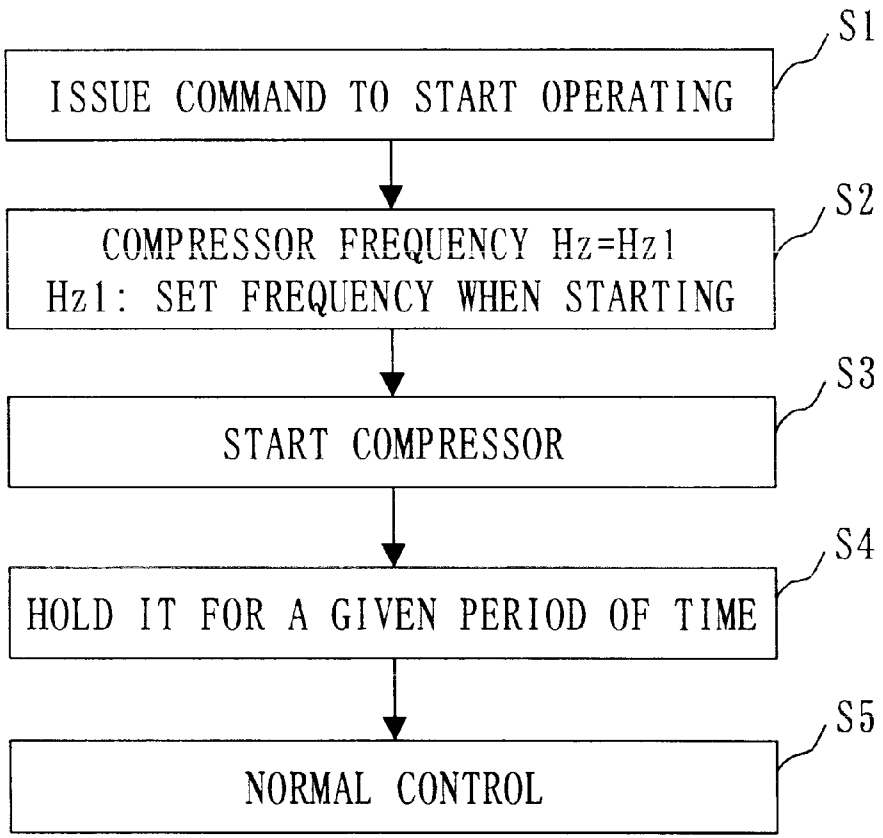
FIG. 4 is a flow chart illustrating a starting controller according to a second embodiment of the present invention.

FIG. 4 is a flow chart illustrating an operation of a start controller according to a second embodiment of the present invention. In a refrigeration cycle having a plurality of indoor heat exchangers, each of the plurality of indoor heat exchangers containing a large amount of a refrigerant, there is wet vapor suction in a large amount in the shell of the compressor 1 when the unit is not working. Inside the compressor 1, liquid refrigerant and weakly soluble oil are separated in two layers to form an oil layer of weakly soluble oil on the surface of the liquid refrigerant. However, the compressor 1 contains parts of rotation such as a rotor provided in the shell at a height of approximately half the height of the shell. Therefore the parts of rotation have to be soaked in the weakly soluble oil. In such a condition, if the compressor is started with a high operation frequency, the weakly soluble oil is disturbed by the parts of rotation. As a result, a large amount of weakly soluble oil flows out from the compressor 1. This may cause the exhaustion of refrigerating machine oil leading to a reliability problem such as poor lubrication in the compressor.

Now, a start control operation of the compressor is now discussed with reference to a flow chart of FIG. 4. Initially, the air conditioner, when issuing a command to start an operation (S1), sets an operation frequency Hz of the compressor to a set frequency Hz1 for starting (S2). Then, the air conditioner starts the compressor with the set frequency (S3), and carries out an operation of the compressor by holding the set frequency without changing for a give period (S4). After the given period, the operation is changed to a normal operation control for the compressor (S5). As aforementioned, according to this embodiment, the operation frequency of the compressor is lowery set at a start of the compressor and an operation is carried out for the given preset period without changing the lowery set frequency. As a result, disturbance caused by the parts of rotation may become small, which may prevent weakly soluble refrigerating machine oil from flowing out from the compressor. Consequently, the compressor is allowed to be free from poor lubrication caused by the exhaustion of refrigerating machine oil. Hence, the reliability of the refrigeration cycle may be enhanced.

With further referring to FIG. 1, a start controller is implemented by the air conditioner and the compressor.

Embodiment 3

Figure 5:
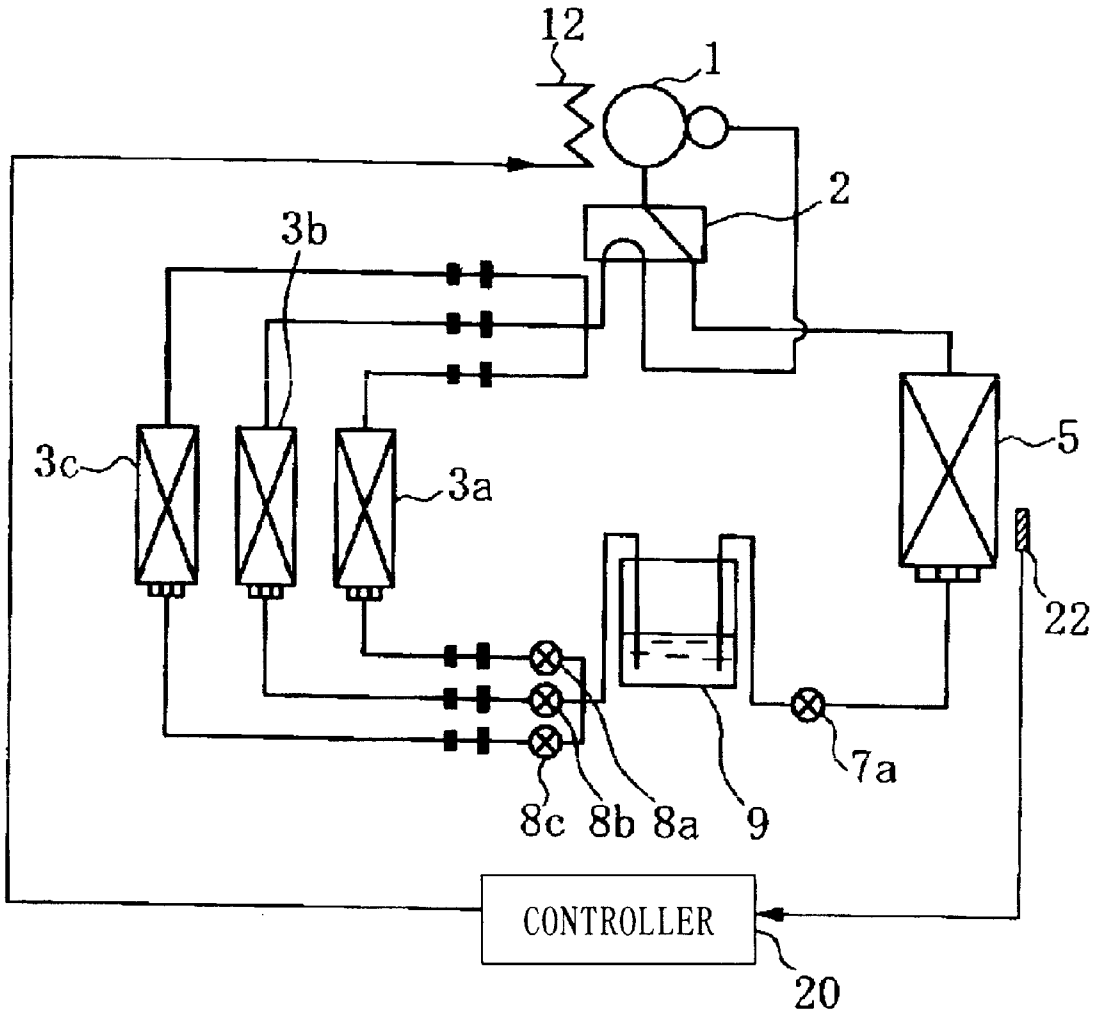
FIG. 5 is a block diagram of a refrigeration cycle for an air conditioner according to a third embodiment of the present invention.

FIG. 5 is a block diagram of a refrigeration cycle for an air conditioner, for example, according to a third embodiment of the present invention. With referring to the figure, a reference numeral 12 denotes a compressor heater. A reference numeral 20 denotes a controller for controlling the compressor heater 12 in accordance with outside air temperature detected by a second temperature sensor 22 (an example of an outside air temperature detector). Other elements shown in FIG. 5 which are the same as or equivalent to those elements of FIG. 1 are assigned the same reference numerals or signs, and will not be discussed here.

As mentioned above, according to the third embodiment, the compressor heater 12 (a heating device) including a heater for heating the compressor 1 and such is provided. Therefore, outside air temperature is detected while the compressor is stopped by the second temperature sensor 22 provided on the suction inlet side of outside air flow of the outdoor heat exchanger 5. As a result, if a detected temperature is lower than a given temperature, the controller 20 controls power supply to the compressor heater 12. This allows to prevent a large amount of liquid refrigerant from stagnating in the compressor resulting in weakly soluble oil floating on the liquid refrigerant layer. This may prevent a large amount of weakly soluble oil from flowing out from the compressor by a disturbance caused by parts of rotation such as a rotor at a start of the compressor 1. For that reason, the compressor is allowed to be free from poor lubrication caused by the exhaustion of refrigerating machine oil. Hence, the reliability of the refrigeration cycle may be enhanced.

Figure 6:
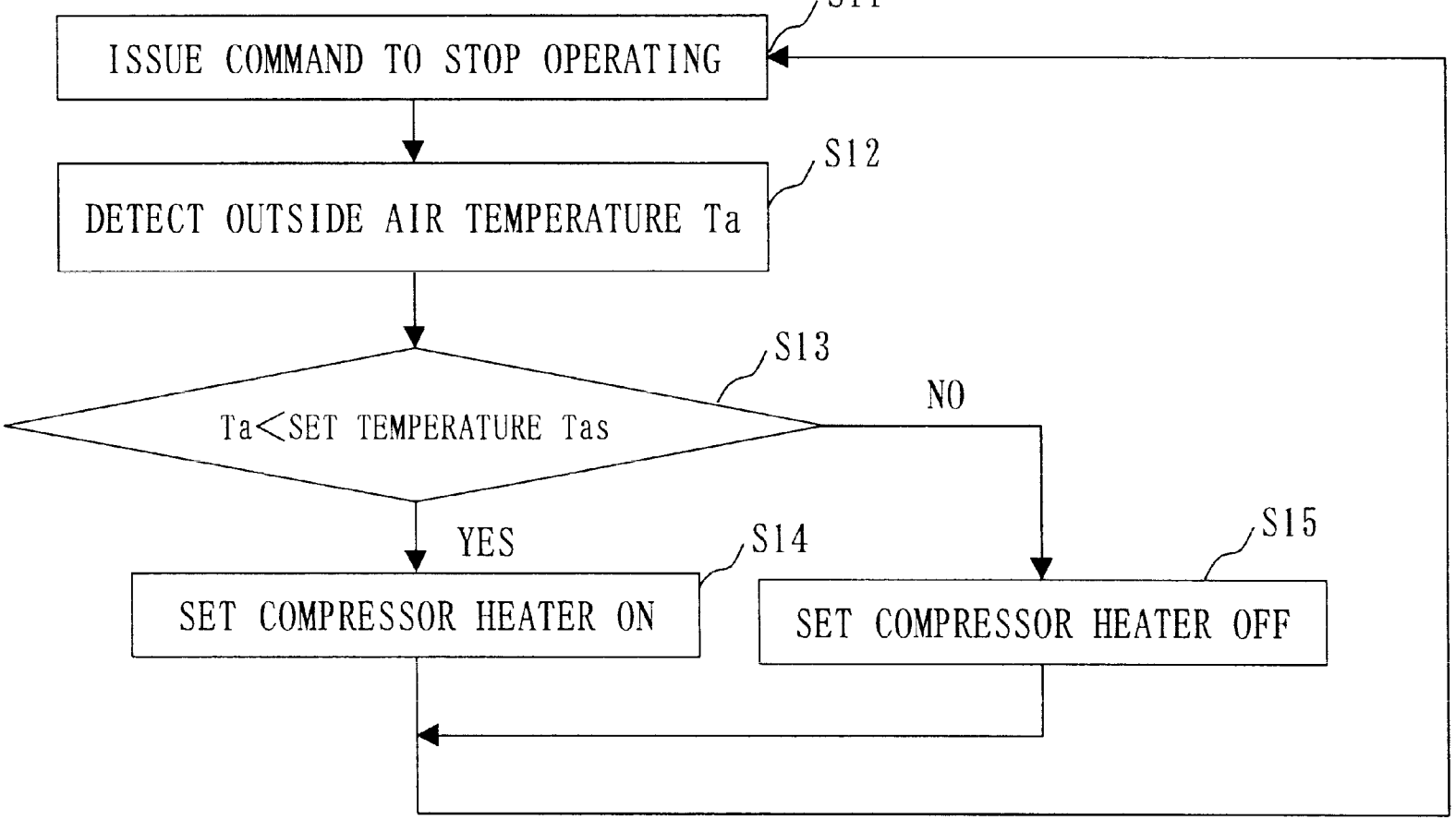
FIG. 6 is a flow chart illustrating a stagnation control according to the third embodiment of the present invention.

FIG. 6 is a flow chart illustrating a control for preventing the stagnation of a refrigerant in the compressor according to the third embodiment of the present invention. The controller 20, during a command issued to stop the operation of the air conditioner (S11), detects an outside air temperature Ta by the second temperature sensor 22 placed on the suction inlet side of the outdoor heat exchanger (S12). Then, the controller 20 compares this detected temperature with a preset temperature Tas (S13). If the detected temperature is lower, then the controller 20 turns the compressor heater 12 ON (S14). If the detected temperature is higher, then the controller 20 turns the compressor heater OFF (S15).

Thus, according to the third embodiment, when an outside air temperature drops, the compressor 1 is heated by the compressor heater 12. This allows to prevent a large amount of liquid refrigerant from stagnating in the compressor 1 resulting in weakly soluble oil floating on the liquid refrigerant layer. This may prevent a large amount of weakly soluble oil from flowing out from the compressor by a disturbance caused by parts of rotation such as a rotor at a start of the compressor 1. Consequently, the compressor is allowed to be free from poor lubrication caused by the exhaustion of refrigerating machine oil. Hence, the reliability of the refrigeration cycle may be enhanced.

Embodiment 4

Figure 7:
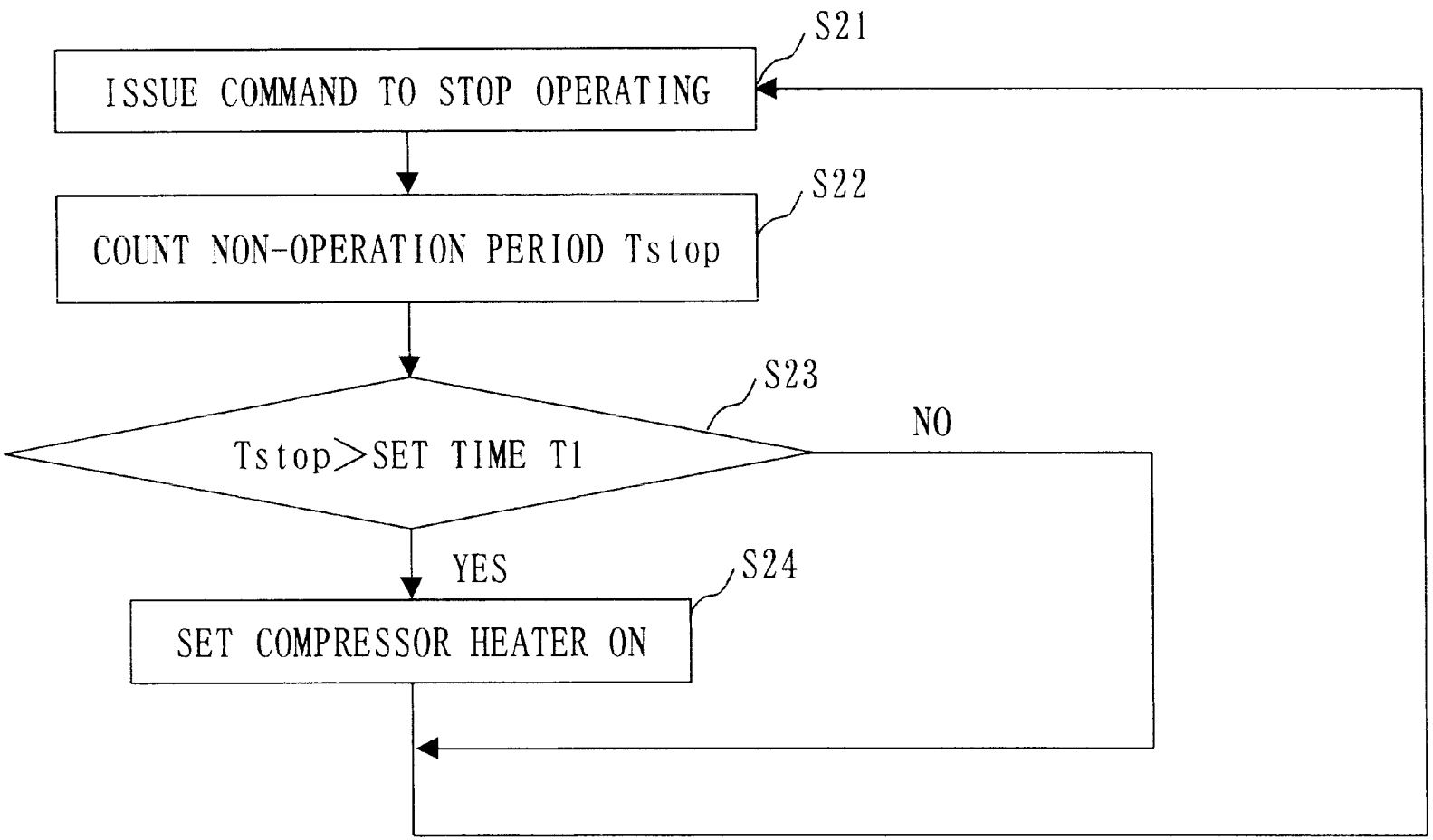
FIG. 7 is a flow chart illustrating a stagnation control according to a fourth embodiment of the present invention.

FIG. 7 is a flow chart illustrating a control for preventing the stagnation of a refrigerant in the compressor according to a fourth embodiment of the present invention. The controller 20 counts a not-operating period of the compressor Tstop (S22) from the time when a command is issued to stop the operation of the air conditioner (S21). Then, the controller 20 compares this Tstop with a preset time T1 (S23). If the Tstop gets longer than the preset time T1, then the controller 20 turns the compressor heater 12 ON (S24). If the gets shorter than the preset time, on the other hand, then the controller 20 continues counting the not-operating period of the compressor.

In the above discussion, the controller 20 is provided with the function of the non-operation period counter for counting the not-operating period of the compressor as an example. Alternatively, however, the compressor heater may be provided with the stopping time counter.

Thus, according to the fourth embodiment, the not-operating period of the compressor Tstop is counted, and if the stopping time becomes longer than the preset time T1, then power is supplied to the compressor heater 12 to turn it ON to heat the compressor 1. This allows to prevent a large amount of the liquid refrigerant from stagnating in the compressor resulting in the weakly soluble oil floating on the liquid refrigerant layer. This may prevent a large amount of weakly soluble oil from flowing out from the compressor by a disturbance caused by parts of rotation such as a rotor at a start of the compressor 1. Consequently, the compressor is allowed to be free from poor lubrication caused by the exhaustion of refrigerating machine oil. Hence, the reliability of the refrigeration cycle may be enhanced.

Embodiment 5

Figure 8:
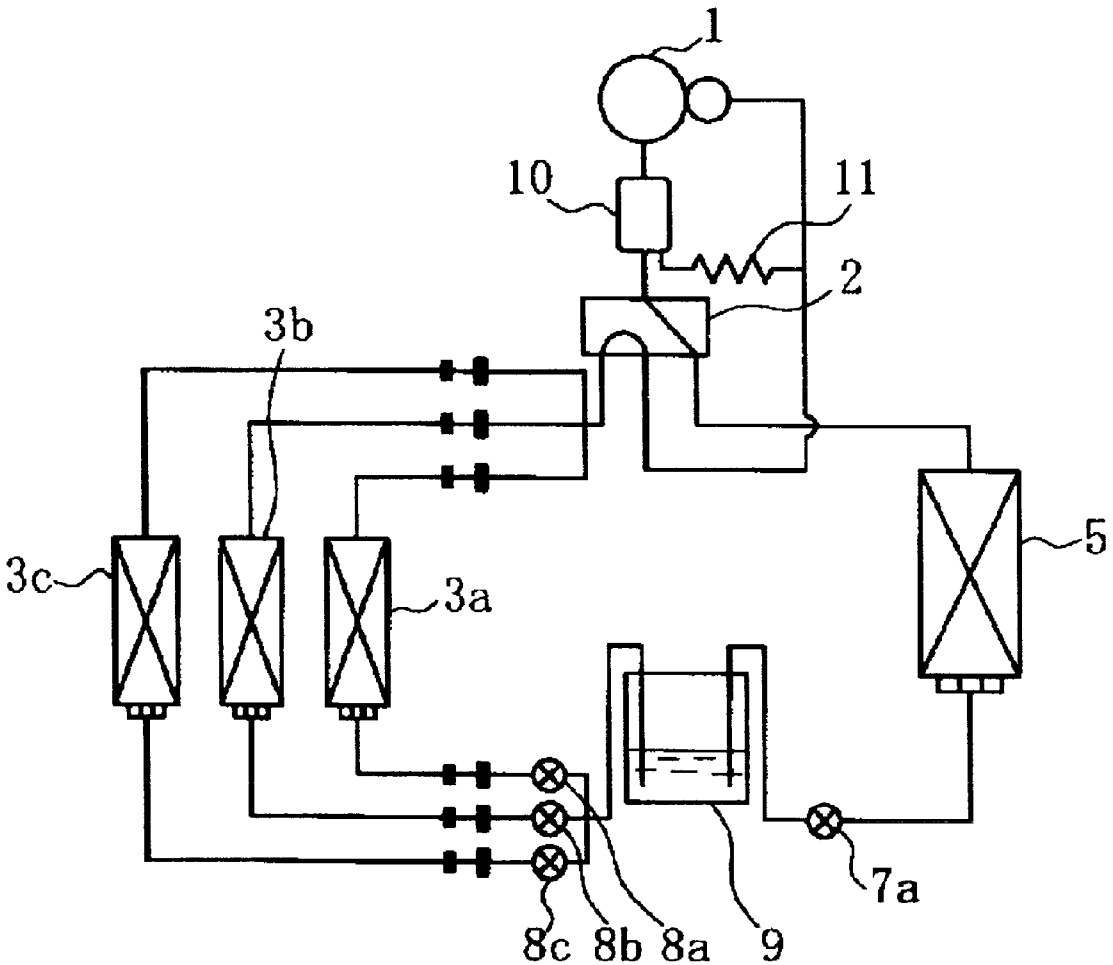
FIG. 8 is a block diagram of a refrigeration cycle for an air conditioner according to a fifth embodiment of the present invention.

FIG. 8 is a block diagram of a refrigeration cycle for an air conditioner according to a fifth embodiment of the present inventions. FIG. 8 shows the refrigeration cycle in a cooling operation. Elements shown in FIG. 8 which are the same as or equivalent to the elements of FIG. 1 discussed in the first embodiment are assigned the same reference numerals or signs, and will not be discussed here. With referring to FIG. 8, a reference numeral 10 denotes an oil separator and a reference numeral 11 denotes a capillary tube for returning oil. Weakly soluble oil discharged from the compressor 1 together with refrigerant gas is guided to enter the oil separator 10 where the refrigerant gas and the weakly soluble oil are separated. Then, the refrigerant gas flows out to the four-way valve from the oil separator whereas separated weakly soluble oil is decompressed through the capillary tube 11 for returning oil and then returned to the compressor through the suction inlet tube.

An effect of the refrigeration cycle of this embodiment may be summarized as follows. By the use of the oil separator 10, the oil circulation rate of weakly soluble oil flowing out in the refrigeration cycle is reduced. Therefore, if using a compressor having a large outflow of oil, it is allowed to hold the oil circulation rate of weakly soluble oil as low as or lower than the saturation solubility of refrigerating machine oil of liquid refrigerant reserved in the receiver 9. As a result, weakly soluble oil in residual refrigerant may stay dissolved in the liquid refrigerant in the receiver 9 without being separated in two layers to stagnate. Thus, the oil is not prevented from returning to the compressor.

As discussed above, the refrigeration cycle according to this embodiment is characterized by having an oil circulation rate regulator for regulating the oil circulation rate of refrigerating machine oil flowing in the refrigeration cycle. The oil circulation rate is regulated in such a manner as to become as low as or lower than the saturation solubility of the refrigerating machine oil of liquid refrigerant reserved in the refrigeration cycle. The oil circulation rate regulator is implemented by the oil separator 10 and the capillary tube for returning oil 11 according to this embodiment.

Embodiment 6

Figure 9:
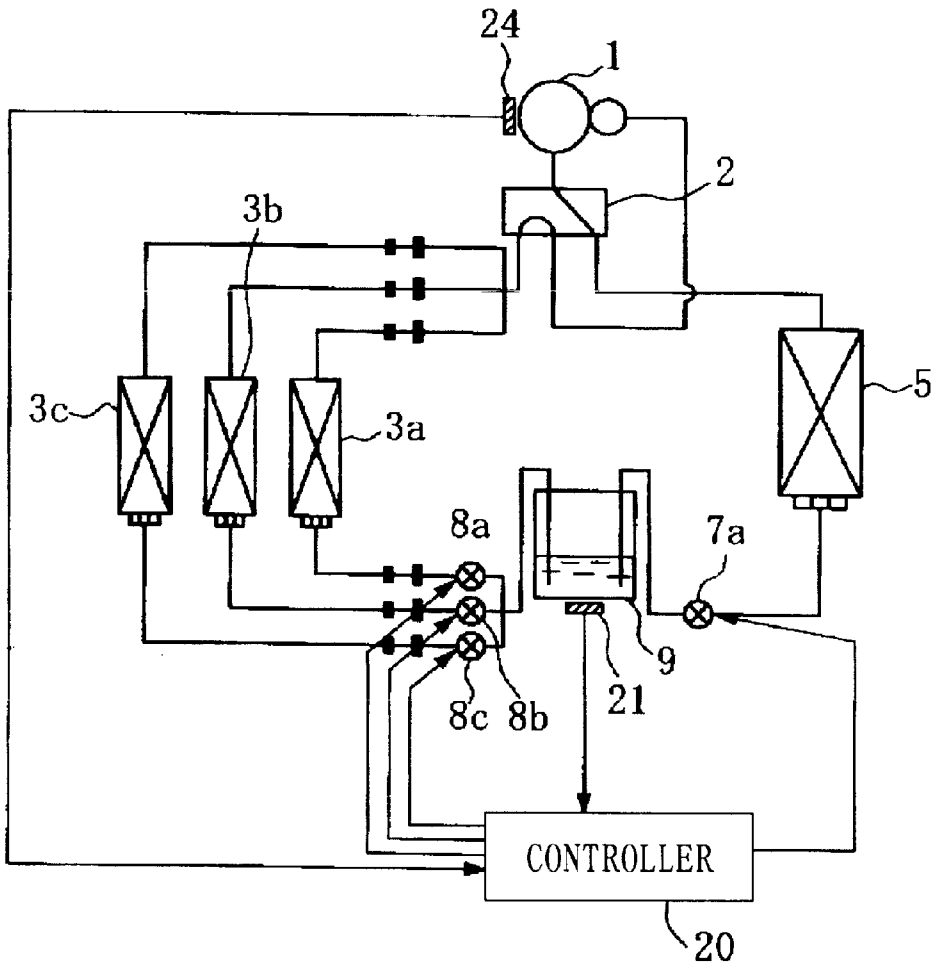
FIG. 9 is a block diagram of a refrigeration cycle according to a sixth embodiment of the present invention.
Figure 10:
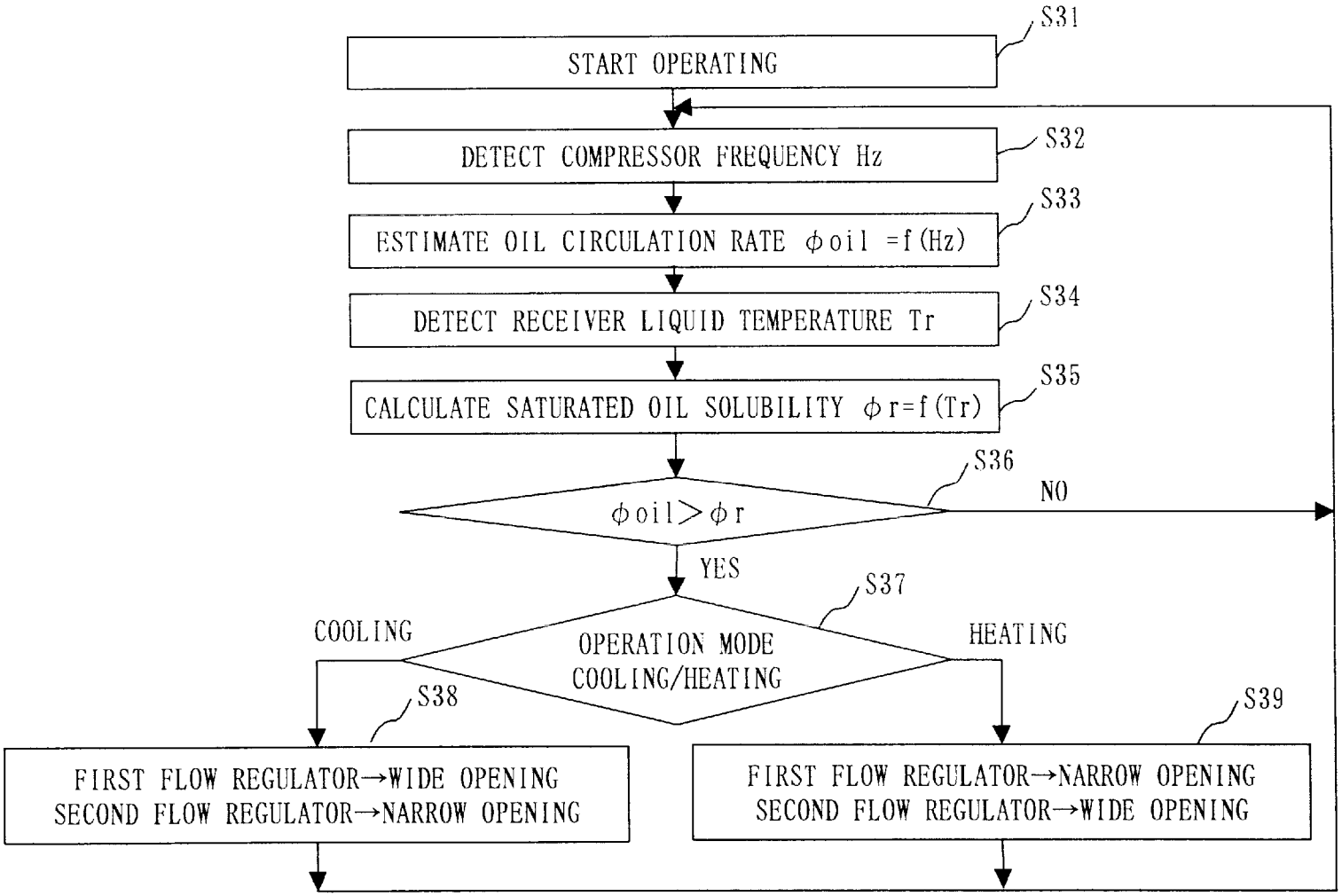
FIG. 10 is a flow chart illustrating a flow control according to the sixth embodiment of the present invention.

FIG. 9 is a block diagram illustrating a refrigeration cycle for an air conditioner, for example, according to a sixth embodiment of the present invention. FIG. 10 is a flow chart illustrating a flow control according to the sixth embodiment of the present invention. With referring to FIG. 9, a reference numeral 20 denotes a controller. A reference numeral 21 denotes a first temperature sensor placed on the outside surface of the receiver 9. A reference numeral 24 denotes a fourth temperature sensor placed on the outside surface of the compressor 1. Other elements shown in FIG. 9 which are the same as or equivalent to the elements of FIG. 1 discussed in the first embodiment are assigned the same reference numerals or signs, and will not be discussed here.

An operation is now discussed with reference to FIG. 10. The controller 20 of the air conditioner detects a compressor operating frequency Hz (S32) and estimates an oil circulation rate ϕoil of the compressor which has a correlation with this compressor operating frequency (S33) Meanwhile, the controller 20 detects a temperature Tr of liquid refrigerant reserved in the receiver (receiver liquid temperature) by the first temperature sensor 21 placed on the outside surface of the receiver 9 (S34), and calculates a saturated oil solubility ϕr of the liquid refrigerant in the receiver 9 (S35). Then, the controller 20 compares this saturated oil solubility ϕr with the oil circulation rate of the compressor ϕoil (S36). As a result, if the oil circulation rate of the compressor ϕoil is larger than the saturated oil solubility ϕr, then the controller 20 increases the opening of the first flow regulator 7*a* and reduces the opening of the respective second flow regulators 8*a,* 8*b,* 8*c* in a cooling operation (S38). The controller 20 increases the opening of the respective second flow regulators 8*a,* 8*b,* 8*c* and reduces the opening of the first flow regulator 7*a* in a heating operation (S39). This may increase pressure inside the receiver 9 and increases the temperature of the liquid refrigerant. This may increase the saturated oil solubility ϕr of the liquid refrigerant. Thus, the saturated oil solubility ϕr of the liquid refrigerant is controlled so as to become larger than the oil circulation rate ϕoil of the compressor.

An effect of the refrigeration cycle of this embodiment may be summarized as follows. The opening of the first flow regulator and the opening of the respective second flow regulators are controlled such that the saturated oil solubility ϕr of liquid refrigerant in the receiver 9 becomes greater than the oil circulation rate ϕr oil of the compressor. For that reason, weakly soluble oil in residual refrigerant in the receiver 9 is not separated in two layers to stagnate. The weakly soluble oil stays dissolved in liquid refrigerant in the receiver 9. Thus, the oil is not prevented from returning to the compressor.

As discussed above, the refrigeration cycle according to this embodiment is characterized by having the first detector for detecting the temperature or pressure of liquid refrigerant reserved in the receiver, and a controller for controlling the temperature or pressure of the liquid refrigerant in the receiver. The temperature or pressure is controlled in such a manner as that the saturation solubility of refrigerating machine oil of the liquid refrigerant becomes as high as or higher than the oil circulation rate of the refrigerating machine oil flowing in the refrigeration cycle. The first detector is implemented by the first temperature sensor 21 and a function included in the controller 20 according to this embodiment.

Embodiment 7

Figure 11A:
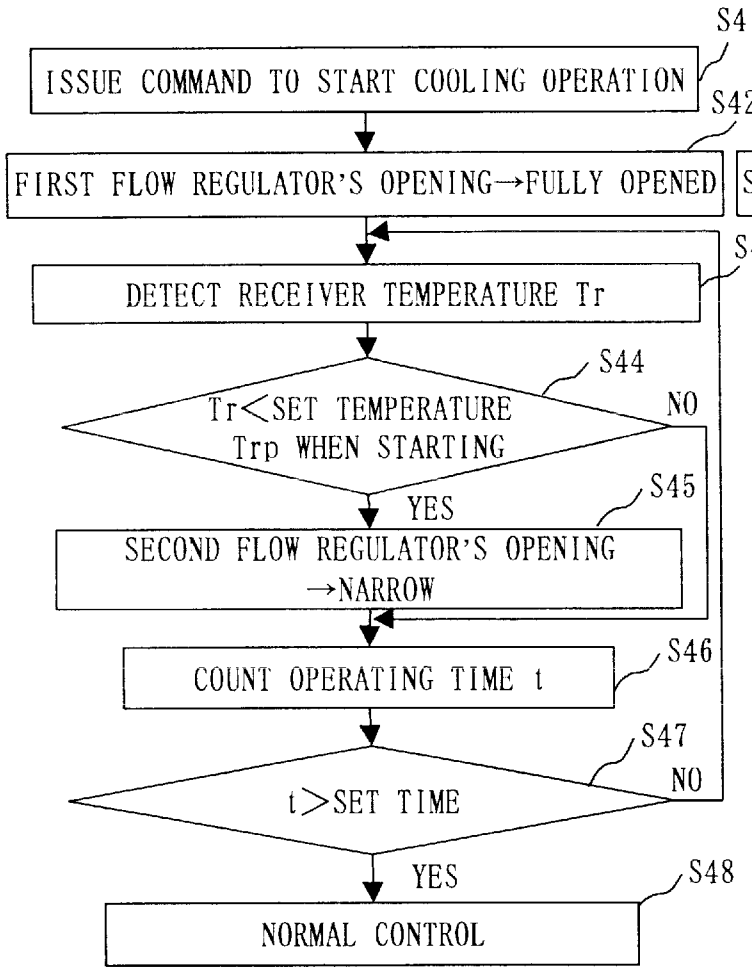
FIG. 11A is a flow chart illustrating a flow control in a cooling operation according to a seventh embodiment of the present invention.
Figure 11B:
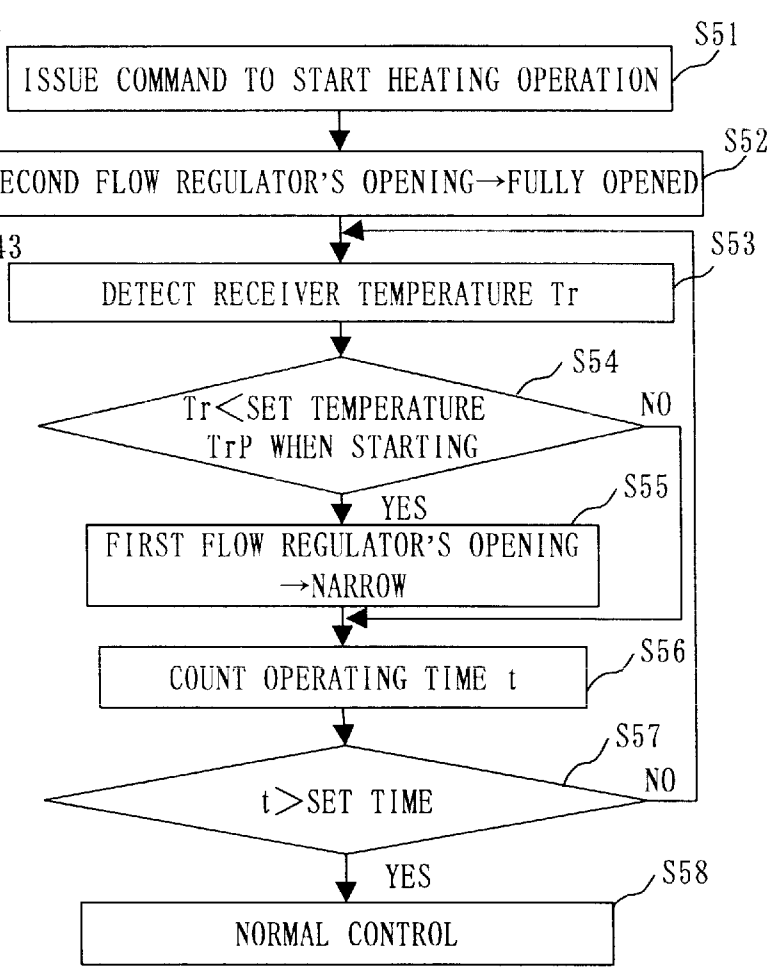
FIG. 11B is a flow chart illustrating a flow control in a heating operation according to the seventh embodiment of the present invention.

FIG. 11A and FIG. 11B illustrate a flow control according to a seventh embodiment of the present invention. FIG. 11A is a flow chart of a cooling operation and FIG. 11B is a flow chart of a heating operation. The refrigeration cycle of this embodiment is the same as that of FIG. 9. An operation will be discussed with reference to the flow charts of FIG. 11A and FIG. 11B. For example, when starting a cooling operation (S41), the controller 20 opens the first flow regulator 7*a* fully (S42). Then, the controller 20 detects the receiver temperature Tr by the first temperature sensor 21 provided on the receiver 9 (S43), and compares this detected temperature with the preset set temperature for starting Trp (S44). As a result, if the receiver temperature Tr is lower than the set temperature for starting Trp, the opening of the second flow regulators 8*a,* 8*b,* 8*c* are reduced (S45). At the same time, the controller 20 starts counting the operating time t (S46). As a result, if a counted operating time t is within a set time, then the condition that receiver temperature Tr>start set time temperature Trp is held (S47). If a counted operating time t is longer than the set time, then the operation is changed to the normal control (S48).

Now, when starting a heating operation (S51), the controller 20 opens the second flow regulators 8*a,* 8*b,* 8*c* fully (S52), and detects the receiver temperature Tr by the first temperature sensor 21 provided on the receiver 9 (S53). If this detected temperature is lower than the set temperature for starting Trp, then the opening of the first flow regulator 7*a* is reduced (S55). At the same time, the controller 20 starts counting the operating time t (S56). As a result, if a counted operating time t is within the set time (S57), then the condition that receiver temperature Tr>set temperature for starting Trp is held. If a counted operating time t is longer than the set time, then the operation is changed to the normal control (S58).

An effect of the refrigeration cycle of this embodiment may be summarized as follows. If there is a transient increase in an amount of refrigerating machine oil flowing out from the compressor 1 at a start of an operation, the temperature of liquid refrigerant in the receiver 9 is increased to raise the saturated oil solubility of the liquid refrigerant. This allows weakly soluble oil to stay dissolved in the liquid refrigerant in the receiver 9 without being separated in two layers to stagnate in the receiver 9. As a result, the oil is not prevented from returning to the compressor 1. Alternatively, instead of detecting the temperature, pressure in the receiver may be detected to obtain the same control effect as that discussed above.

Embodiment 8

Figure 12:
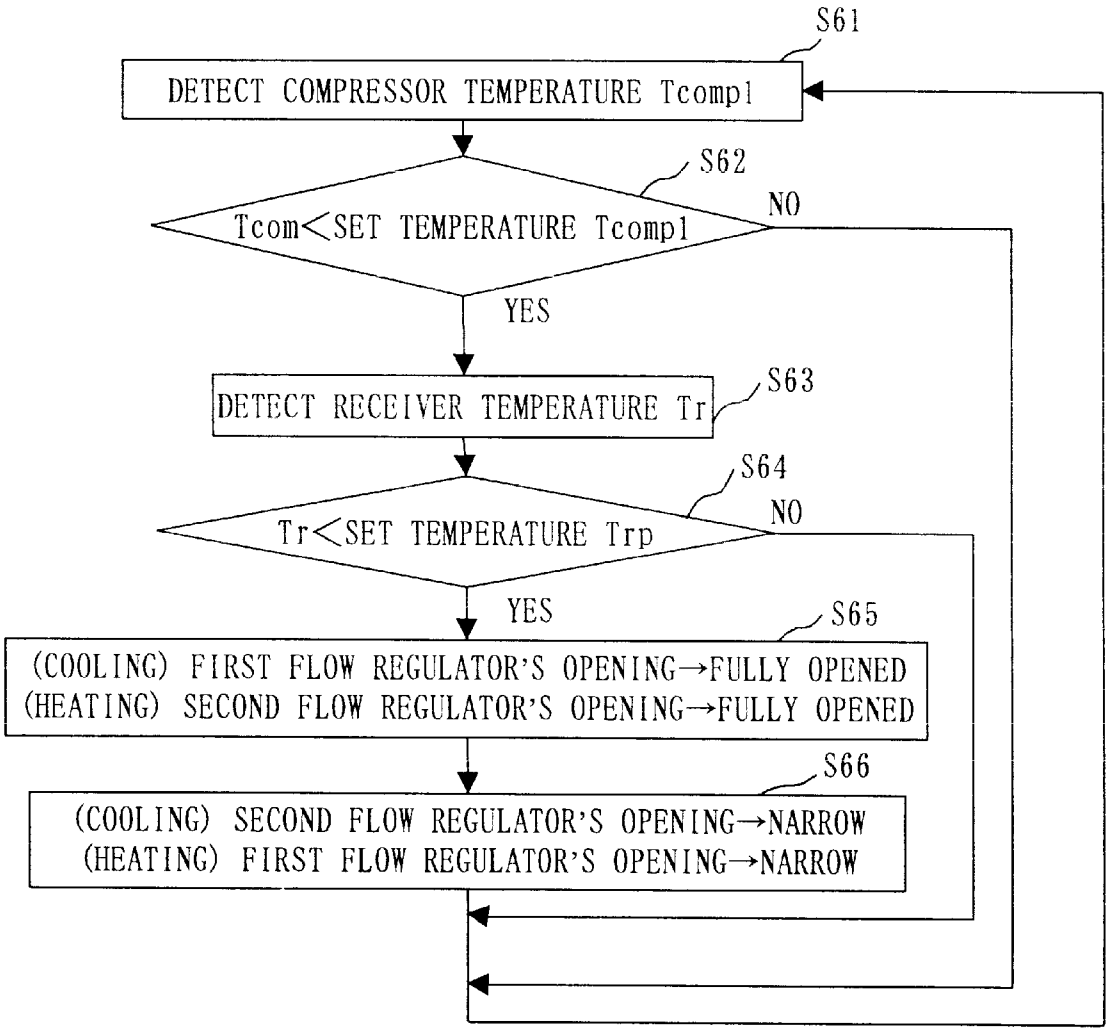
FIG. 12 a flow chart illustrating a flow control according to an eighth embodiment of the present invention.

FIG. 12 is a flow chart illustrating a flow control according to a twelfth embodiment of the present invention. A refrigeration cycle to be used in this embodiment is the same as that of FIG. 9. The controller 20 of an air conditioner detects the compressor temperature Tcomp by the fourth temperature sensor 24 (a fourth temperature detector) placed on the outside surface of the compressor or on the discharge pipe (S61). Then, the controller compares this compressor temperature Tcomp with a preset set temperature Tcomp1 (S62). As a result, if the compressor temperature Tcomp is higher than the set temperature Tcomp1, no change is made in the flow control and the operating step returns to S61 for detecting the compressor temperature. If Tcomp is lower than the set temperature Tcomp1, then it is considered that there is wet vapor suction in the compressor 1 and an increasing amount of the refrigerating machine oil is flowing out from the compressor. Then, the receiver temperature Tr is detected by the first temperature sensor 21 provided on the receiver 9 (S63) in the first place. Then, this receiver temperature Tr and the set temperature Trp are compared (S64). As a result, if the receiver temperature Tr is higher than the set temperature Trp, no change is made in the flow control, and the operating step returns to the detection of the compressor temperature Tcomp (S61). If the receiver temperature Tr is not higher than the set temperature Trp, to the contrary, the operating step proceeds to the next step for flow control. In a cooling operation, the first flow regulator 7*a* is opened fully (S65), and the second flow regulators 8*a,* 8*b,* 8*c* are closed, whereby controlling the receiver temperature Tr so as to become higher than the set temperature Trp (S66). In a heating operation, on the other hand, the second flow regulators 8*a,* 8*b,* 8*c* are fully opened (S65) and the first flow regulator 7*a* is closed (S66), whereby controlling the receiver temperature Tr detected by the first temperature sensor so as to become higher than the preset set temperature for starting Trp.

An effect of the refrigeration cycle of this embodiment may be summarized as follows. If there is wet vapor suction into the compressor 1, and then an amount of the refrigerating machine oil flowing out from the compressor is increased, the temperature of the liquid refrigerant in the receiver 9 is raised to increase the saturated oil solubility of the liquid refrigerant. As a result, weakly soluble oil is allowed to stay dissolved in the liquid refrigerant in the receiver 9 without being separated in two layers to stagnate in the receiver 9. Also, the oil is not prevented from returning to the compressor 1. Alternatively, instead of detecting the temperature of the compressor, the temperature of discharge liquid refrigerant from the compressor may be detected to obtain the same control effect as stated above. Still alternatively, instead of detecting the receiver temperature, pressure in the receiver may be detected to obtain the same control effect.

Embodiment 9

Figure 13A:
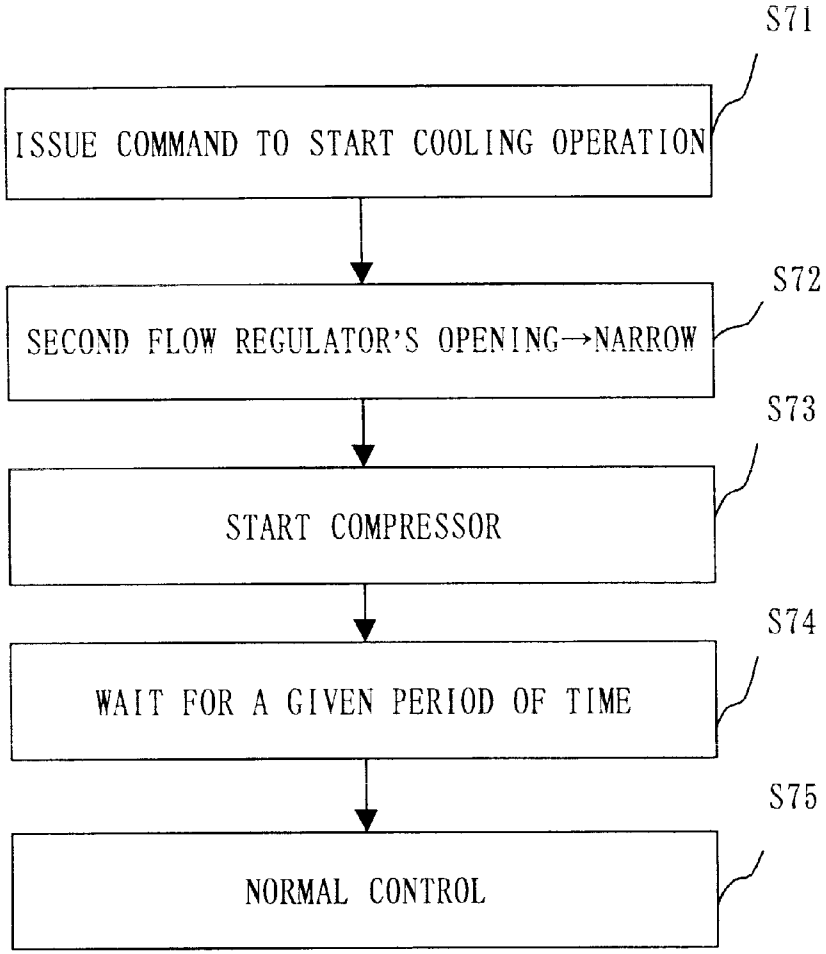
FIG. 13A is a flow chart illustrating a starting control in a cooling operation according to a ninth embodiment of the present invention.
Figure 13B:
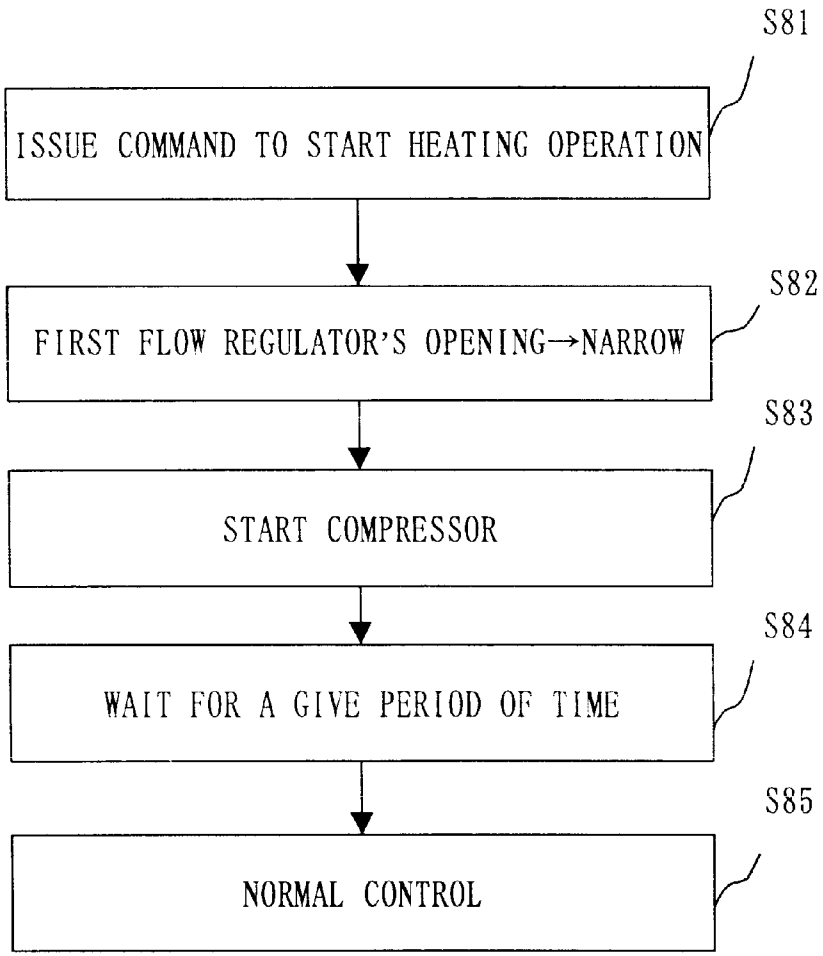
FIG. 13B is a flow chart illustrating a starting control in a heating operation according to the ninth embodiment of the present invention.

FIG. 13A and FIG. 13B illustrate a start control according to a ninth embodiment of the present invention. FIG. 13A is a flow chart illustrating a cooling operation and FIG. 13B is a flow chart illustrating a heating operation. A refrigeration cycle used in this embodiment is the same as that of FIG. 9. An operation will be discussed below. Upon receipt of a command to start a cooling operation (S71), the controller 20 of an air conditioner reduces the opening of the electronic expansion valves of the second flow regulators 8*a,* 8*b,* 8*c* (S72). Then, the controller 20 starts the compressor 1 (S73), and holds the opening of the second flow regulators 8*a,* 8*b,* 8*c* for a given period (S74). After the given period, the controller 20 changes the operation to the normal control (S75). Now, upon receipt of a command to start a heating operation (S81), on the other hand, the controller 20 reduces the opening of the electronic expansion valve of the first flow regulator 7*a* (S82). Then, the controller 20 starts the compressor 1 (S83), and holds the opening of the electronic expansion valve of the first flow regulator 7*a* for a given period (S84). Then, after the given period, the controller changes to the normal control (S85).

The refrigeration cycle of this embodiment, when starting a cooling operation, reduces the openings of the second flow regulators 8*a,* 8*b,* 8*c* placed on the downstream side of the receiver 8 and starts the compressor 1. This may accelerate the accumulation of residual refrigerant in the receiver 9. At the same time, this may stop wet vapor suction into the compressor 1 in a large amount, and prevent the weakly soluble oil from floating on the liquid refrigerant layer in the compressor 1. This may prevent a large amount of weakly soluble oil from flowing out from the compressor by a disturbance caused by parts of rotation such as a rotor in the compressor. As a result, the compressor is allowed to be free from poor lubrication caused by the exhaustion of refrigerating machine oil. Hence, the reliability of the refrigeration cycle may be enhanced. Furthermore, when starting a heating operation, the compressor 1 is started by reducing the opening of the first flow regulator 7*a* placed on the downstream side of the receiver 9. This may accelerate the accumulation of residual refrigerant in the receiver 9. At the same time, this may stop a large amount of liquid refrigerant flowing back to the compressor 1, and prevent weakly soluble oil from floating on the liquid refrigerant layer in the compressor 1. As a result, like the case of starting a cooling operation above, the compressor is allowed to be free from poor lubrication caused by the exhaustion of refrigerating machine oil. Hence, the reliability of the refrigeration cycle may be enhanced.

Embodiment 10

Figure 14:
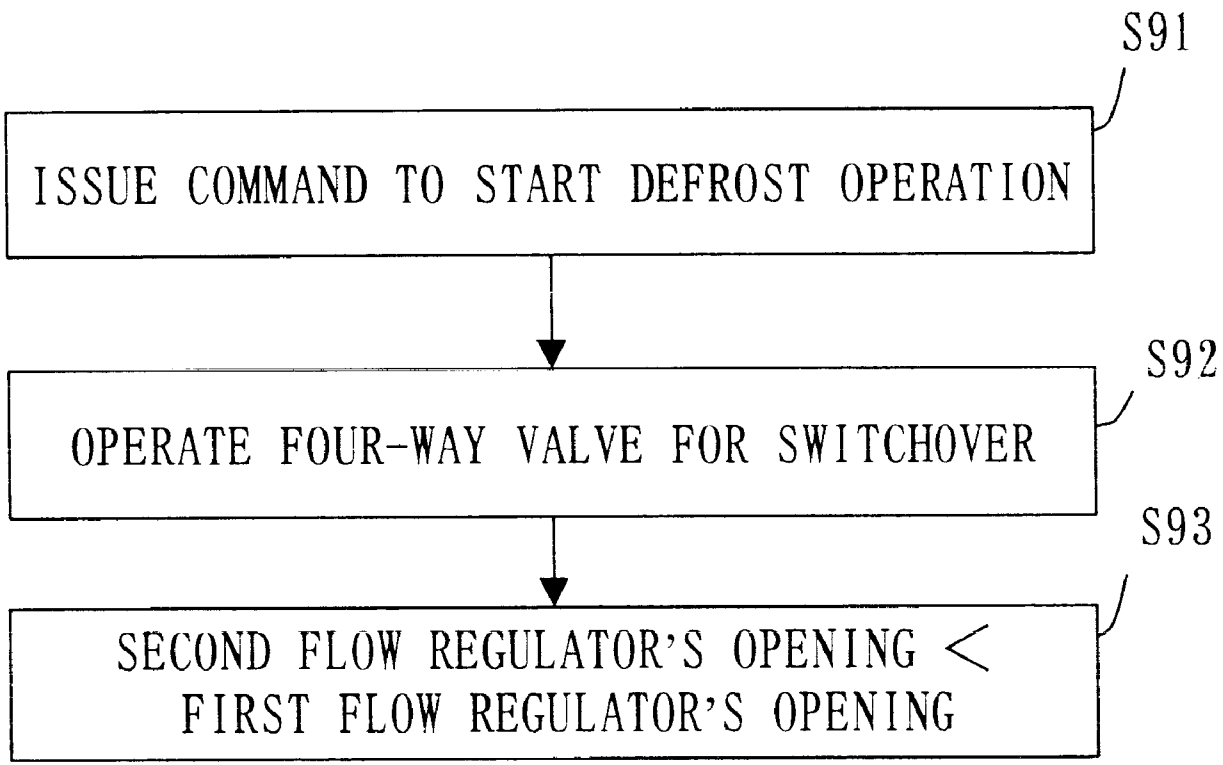
FIG. 14 is a flow chart illustrating a flow control in a defrost operation according to a tenth embodiment of the present invention.

FIG. 14 shows a flow control procedure in a defrost operation according to a tenth embodiment of the present invention. A refrigeration cycle used in this embodiment is the same as that of FIG. 9. An operation will be explained below. Upon issuance of a command to start a defrost operation (S91), the four-way valve 2 is operated to switch from a heating operation to a cooling operation (S92). Then, the openings of the second flow regulators 8*a,* 8*b,* 8*c* placed on the downstream side of the receiver 9 are set to become smaller than the opening of the first flow regulator 7*a* placed on the upstream side (S93).

This embodiment may be summarized as follows. In a defrost operation, the openings of the second flow regulators 8*a,* 8*b,* 8*c* placed on the downstream side of the receiver 9 are set to be smaller than the opening of the first flow regulator 7*a* placed on the upstream side. This may easily accumulate liquid refrigerant in the receiver 9 and stop wet vapor suction in a large amount into the compressor 1, and prevent the weakly soluble oil from floating on the liquid refrigerant layer in the compressor 1. This may prevent a large amount of weakly soluble oil from flowing out from the compressor by a disturbance caused by parts of rotation such as a rotor in the compressor. As a result, the compressor is allowed to be free from poor lubrication caused by the exhaustion of refrigerating machine oil. Hence, the reliability of the refrigeration cycle may be enhanced.

Embodiment 11

Figure 15:
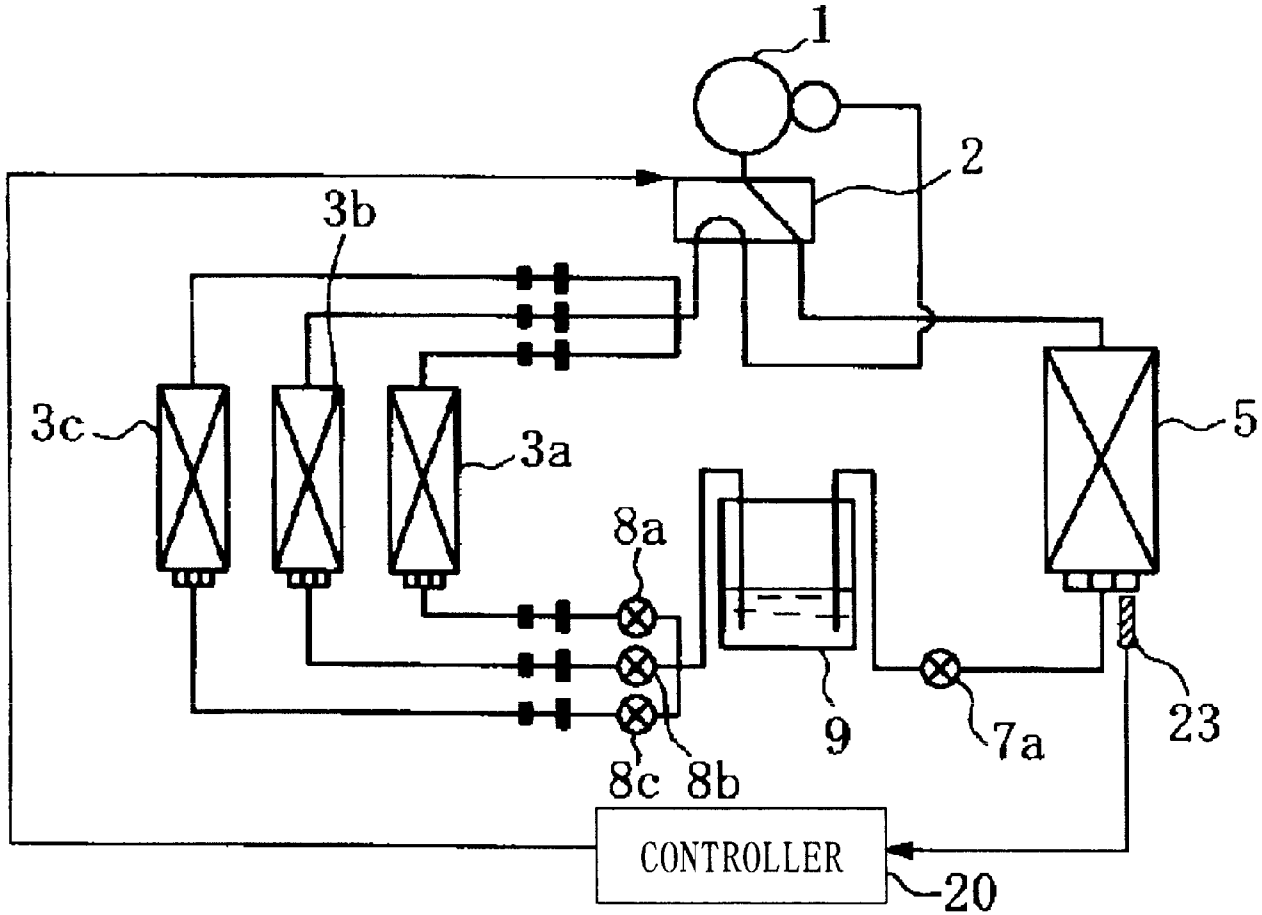
FIG. 15 is a block diagram of a refrigeration cycle for an air conditioner according to an eleventh embodiment of the present invention.
Figure 16:
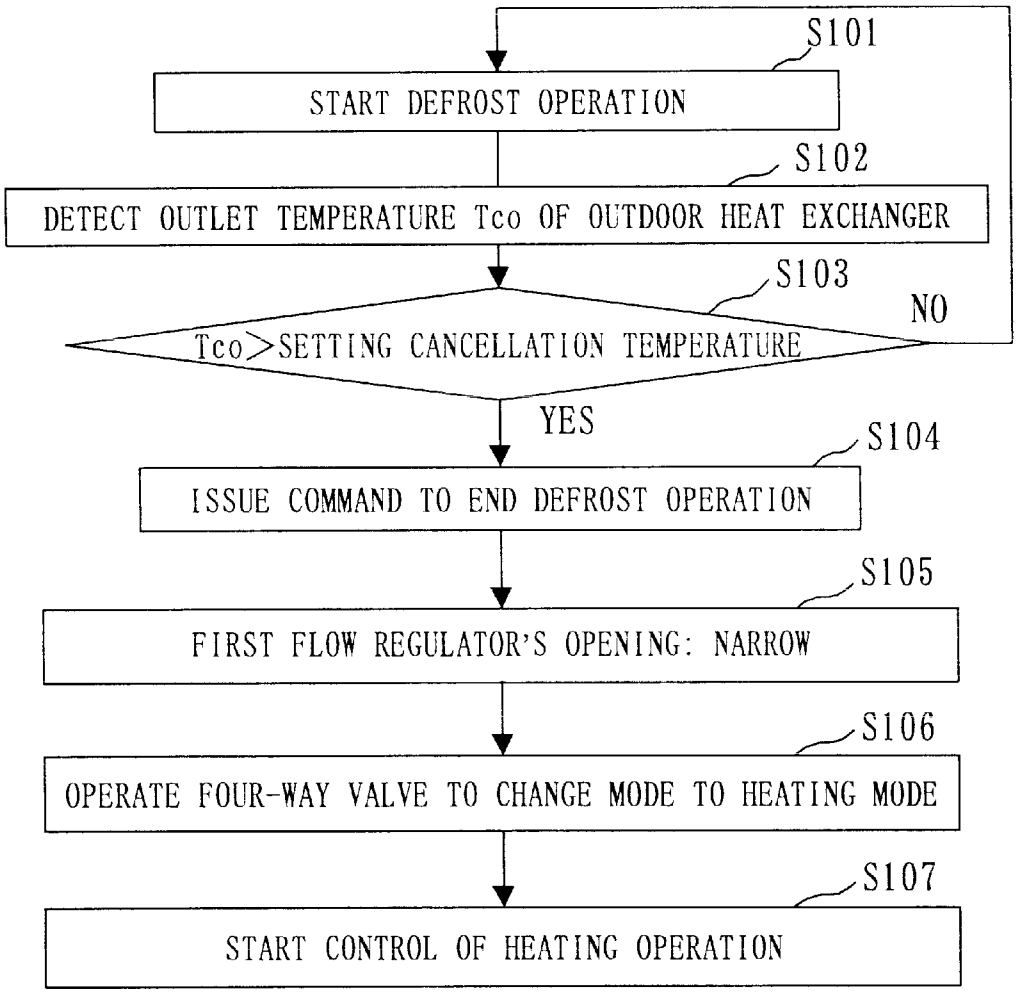
FIG. 16 is a flow chart illustrating a flow control, which is performed at the end of a defrost operation, according to the eleventh embodiment of the present invention.

FIG. 15 is a block diagram of a refrigeration cycle for an air conditioner, for example, according to an eleventh embodiment of the present invention. FIG. 16 is a flow chart illustrating a flow control procedure for ending a defrost operation according to the eleventh embodiment of the present invention. With referring to FIG. 15, a reference numeral 20 denotes a controller, a reference numeral 23 denotes a third temperature sensor (a third temperature detector), which is placed on the pipe on the outlet side of the outdoor heat exchanger 5. Other elements shown in FIG. 15 which are the same as or equivalent to the elements of FIG. 1 discussed in the first embodiment are assigned the same reference numerals or signs, and will not be explained here.

During a defrost operation of the refrigeration cycle, superheated refrigerant gas discharged from the compressor 1 flows into the outdoor heat exchanger 5. Then, the superheated refrigerant gas is heat-exchanged with frost settled on the surface of the fin of the heat exchanger through heat conduction and becomes a liquid refrigerant having a temperature at zero degree centigrade. In such a state that frost settles thickly on the surface of the fin of the outdoor heat exchanger at an initial stage in an defrost operation, because refrigerant gas easily condenses, the pipe of the outdoor heat exchanger 5 is almost filled with liquid refrigerant inside. Therefore, the outdoor heat exchanger 5 contains quite a large amount of refrigerant. As the defrost operation is carried out, the frost starts to thaw and disappears from the surface of the fin. Then, the superheated gas does not condense sufficiently. As a result, the pipe of the outdoor heat exchanger 5 becomes two-phased with gas and liquid inside. Consequently, an amount of remaining refrigerant in the outdoor heat exchanger 5 becomes small.

A flow control operation according to this embodiment is now discussed with reference to the flow chart of FIG. 16. Upon receipt of a command to start a defrost operation (S103), the controller 20 of an air conditioner detects an outlet air temperature Tco of the outdoor heat exchanger 5 by the third temperature sensor 23 placed on the outlet side of the outdoor heat exchanger 5 (S102). Then, the controller 20 compares this detected temperature with a preset setting cancellation temperature (S103). As a result, if the detected temperature Tco is lower than the setting cancellation temperature, the defrost operation is continued. If the detected temperature Tco is higher than the setting cancellation temperature, to the contrary, the controller 20 issues a command to end the defrost operation (S104). Then, under the judgement that an amount of refrigerant existing in the outdoor heat exchanger is not sufficient, the controller 20 reduces the opening of the first flow regulator 7*a* (S105), then operates the four-way valve to change the mode to a heating mode (S106), and then controls the start of a heating operation (S107). This may reduce an amount of wet vapor suction into the compressor 1 of the liquid refrigerant in the outdoor heating exchanger 5. This may also reduce an amount of wet vapor suction into the compressor 1 side from the receiver 9. As a result, weakly soluble oil may be prevented from floating on the liquid refrigerant layer in the compressor 1. This may prevent a large amount of weakly soluble oil from flowing out from the compressor by a disturbance caused by parts of rotation such as a rotor. Consequently, the compressor is allowed to be free from poor lubrication by the exhaustion of oil. Hence, the reliability of the refrigeration cycle may be enhanced.

Embodiment 12

Figure 17:
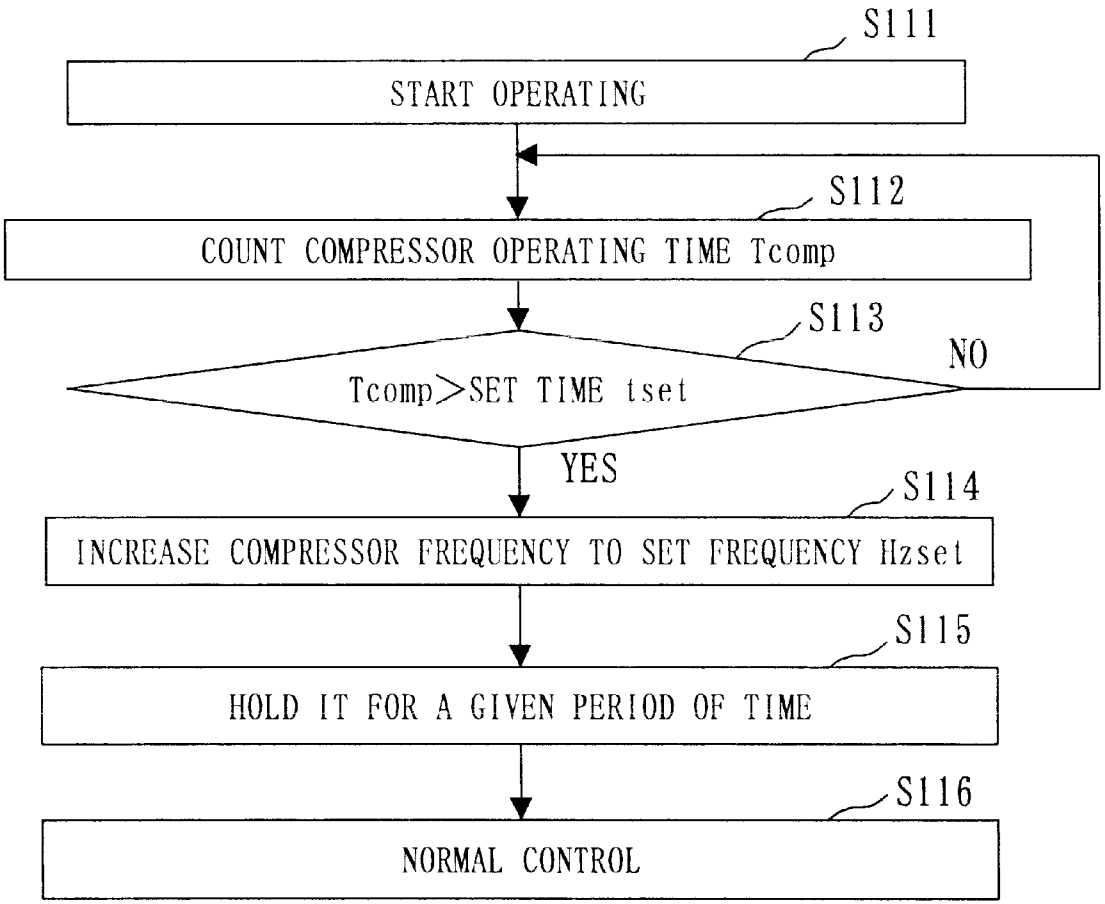
FIG. 17 is a flow chart illustrating an oil removal operation according to a twelfth embodiment of the present invention.

FIG. 17 is a flow chart illustrating an oil removal control procedure according to a twelfth embodiment of the present invention. A refrigeration cycle to be used in this embodiment is the same as that of FIG. 15. If the compressor is operated at a low rate of frequency, for example, the flow rate of a refrigerant circulating in the refrigeration cycle becomes small. In this case, refrigerating machine oil stagnates in the refrigeration cycle, which causes a failure of returning of the oil to the compressor. In particular, with weakly soluble oil, the refrigerating machine oil contains a small amount of refrigerant dissolved therein, a coefficient of viscosity becomes very large in a low-pressure pipe at a low temperature. As a result, a smaller amount of oil is allowed to be returned to the compressor compared with soluble oil. In the light of this respect, according to the refrigeration cycle of this embodiment, the controller 20 of the air conditioner counts a compressor operating time Tcomp (S112), and compares this compressor operating time Tcomp with a set operation time tset (S113). As a result, if the compressor operating time Tcomp is within the set operation time tset, the counting is continued. If the compressor operating time becomes longer than the set operation time tset, then the compressor operating frequency is set to a preset set frequency Hzset to accelerate the operation (S114). Then, the operation is continued with this state being maintained for a given period (S115). After the given period, the operation is changed to the normal operation control (S116).

This embodiment may be summarized as follows. The controller 20 counts the compressor operating time Tcomp. When the compressor operating time exceeds the given set operation time tset, the controller sets an operating frequency of the compressor to the preset set frequency Hzset so as to accelerate the operation. Then, the compressor is operated for the given period. As a result, even if the compressor is operated at a low rate using weakly soluble oil, a periodic return of oil to the compressor may be allowed when the set time comes. Consequently, the compressor is allowed to be free from poor lubrication caused by the exhaustion of refrigerating machine oil. Hence, the reliability of the refrigeration cycle may be enhanced.

Embodiment 13

Figure 18:
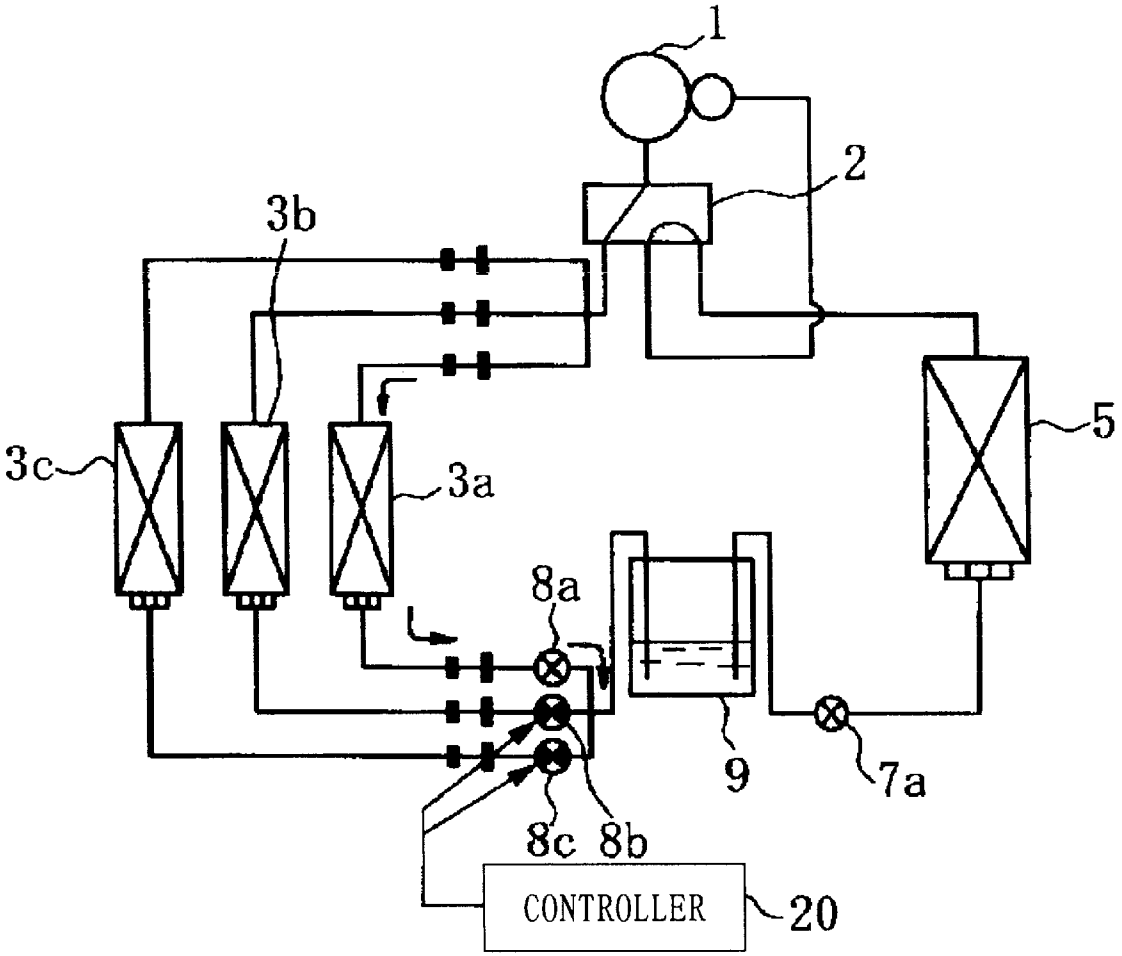
FIG. 18 is a block diagram of a refrigeration cycle for an air conditioner according to a thirteenth embodiment of the present invention.
Figure 19:
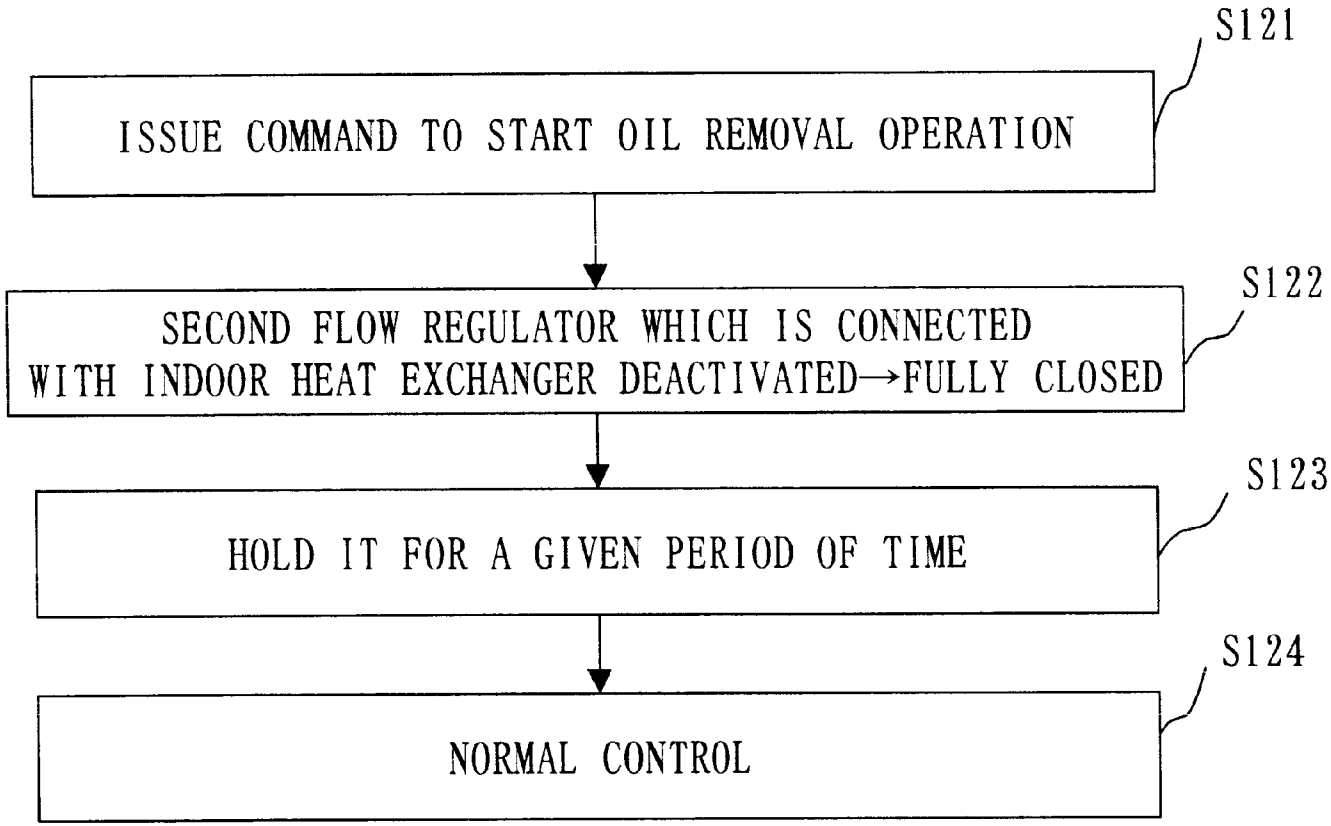
FIG. 19 is a flow chart illustrating an oil removal control for oil reserved from the receiver according to the thirteenth embodiment of the present invention.

FIG. 18 is a block diagram of a refrigeration cycle for an air conditioner, for example, according to a thirteenth embodiment of the present invention. FIG. 19 is a flow chart illustrating an oil removal control procedure for reserved oil in the receiver according to the thirteenth embodiment of the present invention. With referring to FIG. 18, a reference numeral denotes the controller 20. Other elements shown in FIG. 18 which are the same as or equivalent to the elements of FIG. 1 discussed in the first embodiment are assigned the same reference numerals or signs, and will not be explained here. In a transient increase in the outflow of refrigerating machine oil in the compressor, an oil circulation rate in the refrigeration cycle exceeds the saturated oil solubility of the liquid refrigerant in the receiver 9 momentarily. As a result, weakly soluble oil may be separated in two layers to stagnate on the surface of the liquid refrigerant in the receiver 9.

Now, this embodiment is illustrated with reference to the flow chart of FIG. 19. It is assumed that the indoor heat exchanger 3*a* is activated alone and the other indoor heat exchangers 3*b*, 3*c* are deactivated in a heating operation. In this case, the controller 20 of the air conditioner, upon receipt of a command to start an oil removal operation (S121), closes completely the second flow regulators 8*b*, 8*c* connected to the deactivated indoor heat exchangers 3*b*, 3*c* (S122), and maintains this condition for a given period (S123). Through this control operation, gas refrigerant is condensed and reserved as liquid refrigerant in the deactivated indoor heat exchangers 3*b*, 3*c*. After the given period, the operation is changed to the normal control (S124). This removes residual liquid refrigerant from the receiver 9. The weakly soluble oil refrigerant is separated in two layers to float on the surface of the liquid flows out through the pipe in the receiver 9 and returns to the compressor 1. Consequently, the compressor is allowed to be free from poor lubrication caused by the exhaustion of oil. Hence, the reliability of the refrigeration cycle may be enhanced.

Embodiment 14

Figure 20:
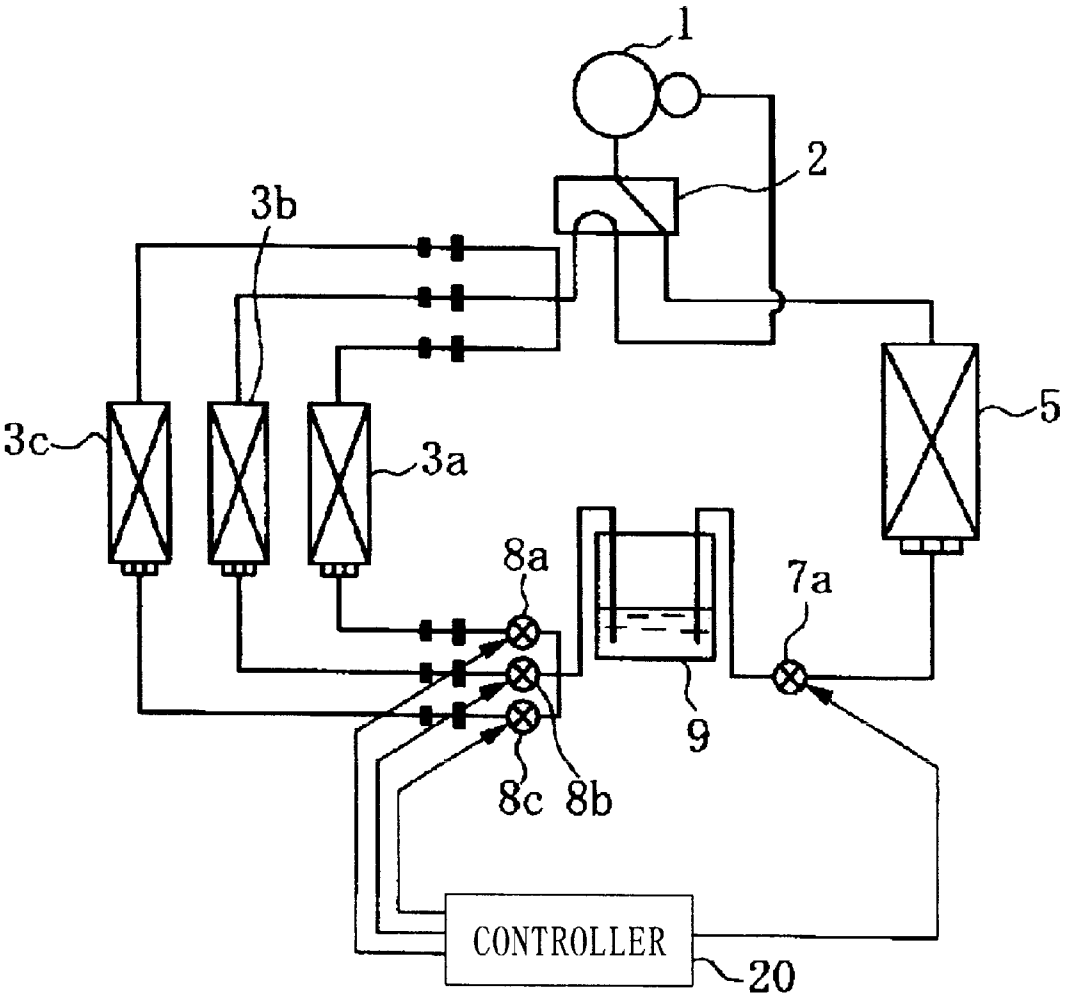
FIG. 20 is a block diagram of a refrigeration cycle for an air conditioner according to a fourteenth embodiment of the present invention.
Figure 21:
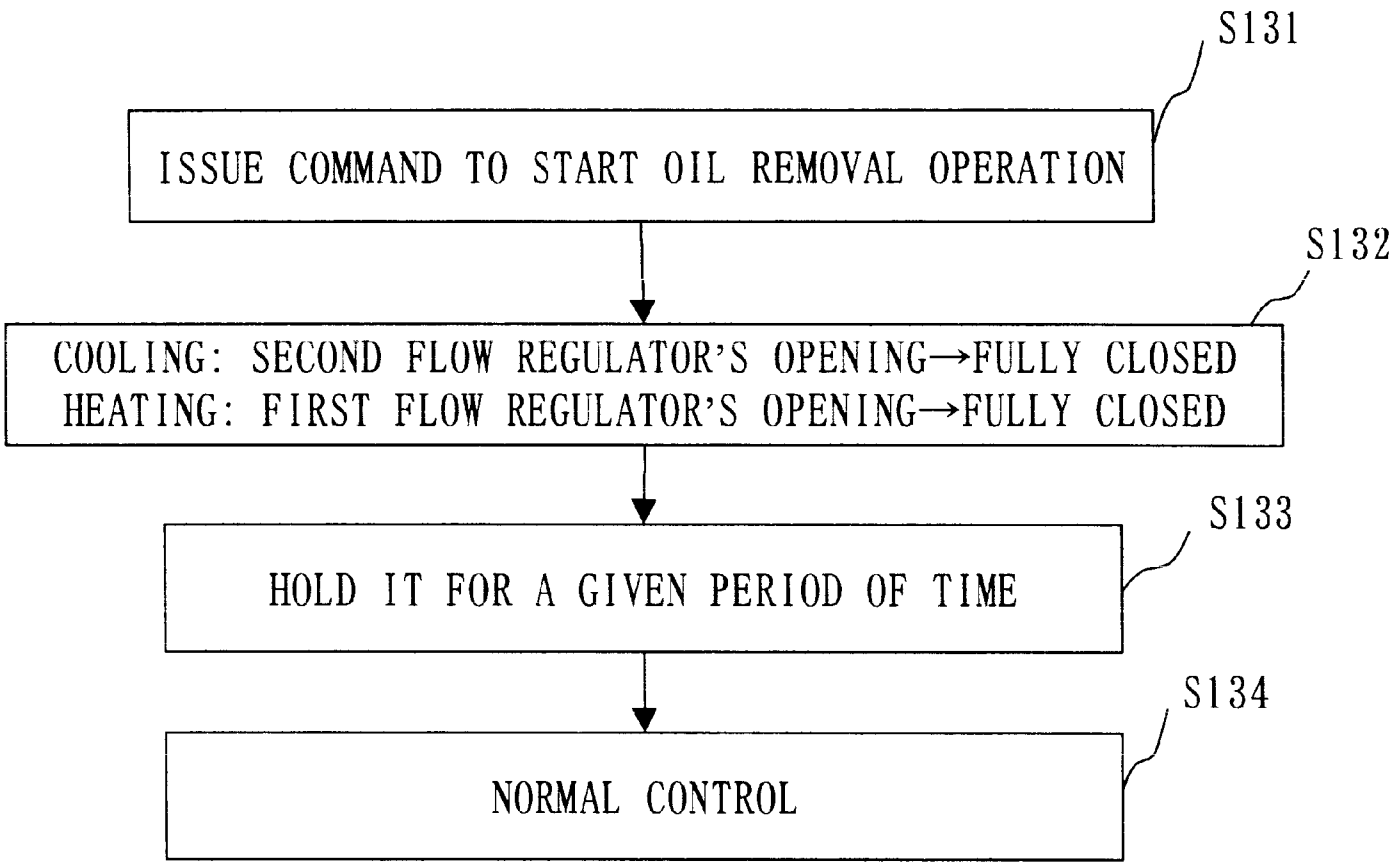
FIG. 21 is a flow chart illustrating an oil removal control for residual oil reserved from the receiver according to the fourteenth embodiment of the present invention.

FIG. 20 is a block diagram of a refrigeration cycle for an air conditioner, for example, according to a fourteenth embodiment of the present invention. FIG. 21 is a flow chart illustrating an oil removal control procedure for oil reserved in the receiver according to the fourteenth embodiment of the present invention. With referring to FIG. 20, the controller 20 controls the first flow regulator 7*a,* the second flow regulators 8*a* to 8*c* and such. Other elements shown in FIG. 20 which are the same as or equivalent to the elements of FIG. 1 are assigned the same reference numerals or signs, and will not be explained here. When an operation is started or re-started after a defrost operation, a transient wet vapor suction into the compressor 1 may occur. Consequently, when weakly soluble oil floats on the liquid refrigerant layer in the compressor 1, if parts of rotation such as a rotor disturbs the liquid, then a large amount of weakly soluble oil may flow out from the compressor. In such a case, an oil circulation rate in the refrigeration cycle may exceed the saturated oil solubility of the liquid refrigerant in the receiver 9 momentarily. As a result, weakly soluble oil separated in two layers may stagnate on the surface of the liquid refrigerant in the receiver 9.

According to this embodiment, as shown in a flow chart in FIG. 21, the controller 20, upon reception of a command to start an oil removal control operation for oil reserved in the receiver (S131), closes the second flow regulators 8*a,* 8*b,* 8*c* fully in a heating operation and closes the first flow regulator 7*a* fully in a cooling operation (S132). Then, the controller 20 maintains this condition for a given period (S133). Thereafter, the operation is changed to the normal control (S134). This operation allows a whole amount of liquid refrigerant and weakly soluble oil in the receiver 9 to flow out to the downstream side of the receiver 9 in the refrigeration cycle so as to return to the compressor 1 on the suction inlet side.

This embodiment may be summarized as follows. The oil removal controller for oil reserved in the receiver is provided to return oil to the compressor 1 on the suction inlet side. For that reason, even if a transient stagnation of weakly soluble oil occurs in the receiver 9, the compressor 1 is allowed to be free from poor lubrication caused by the exhaustion of refrigerating machine oil. Hence, the reliability of the refrigeration cycle may be enhanced.

Embodiment 15

Figure 22:
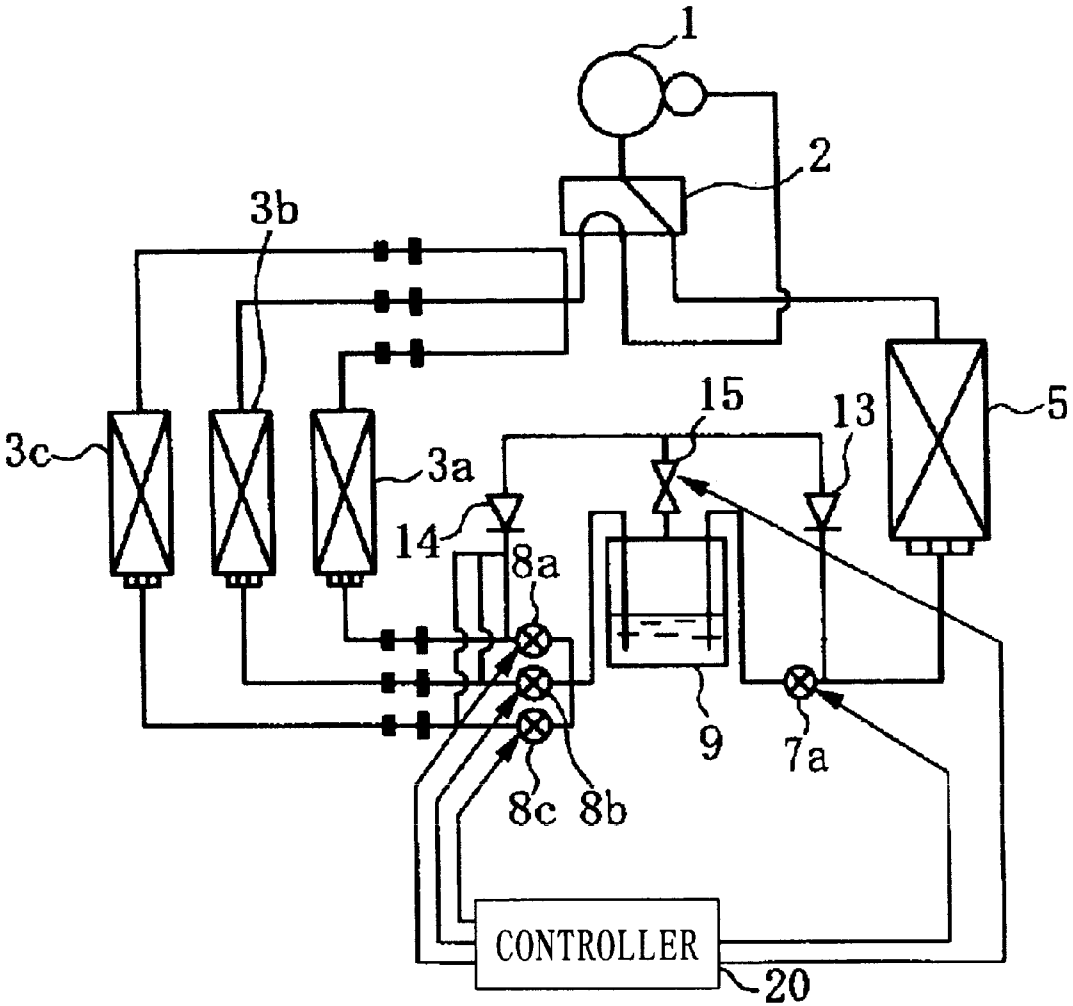
FIG. 22 is a block diagram of a refrigeration cycle for an air conditioner according to a fifteenth embodiment of the present invention.
Figure 23:
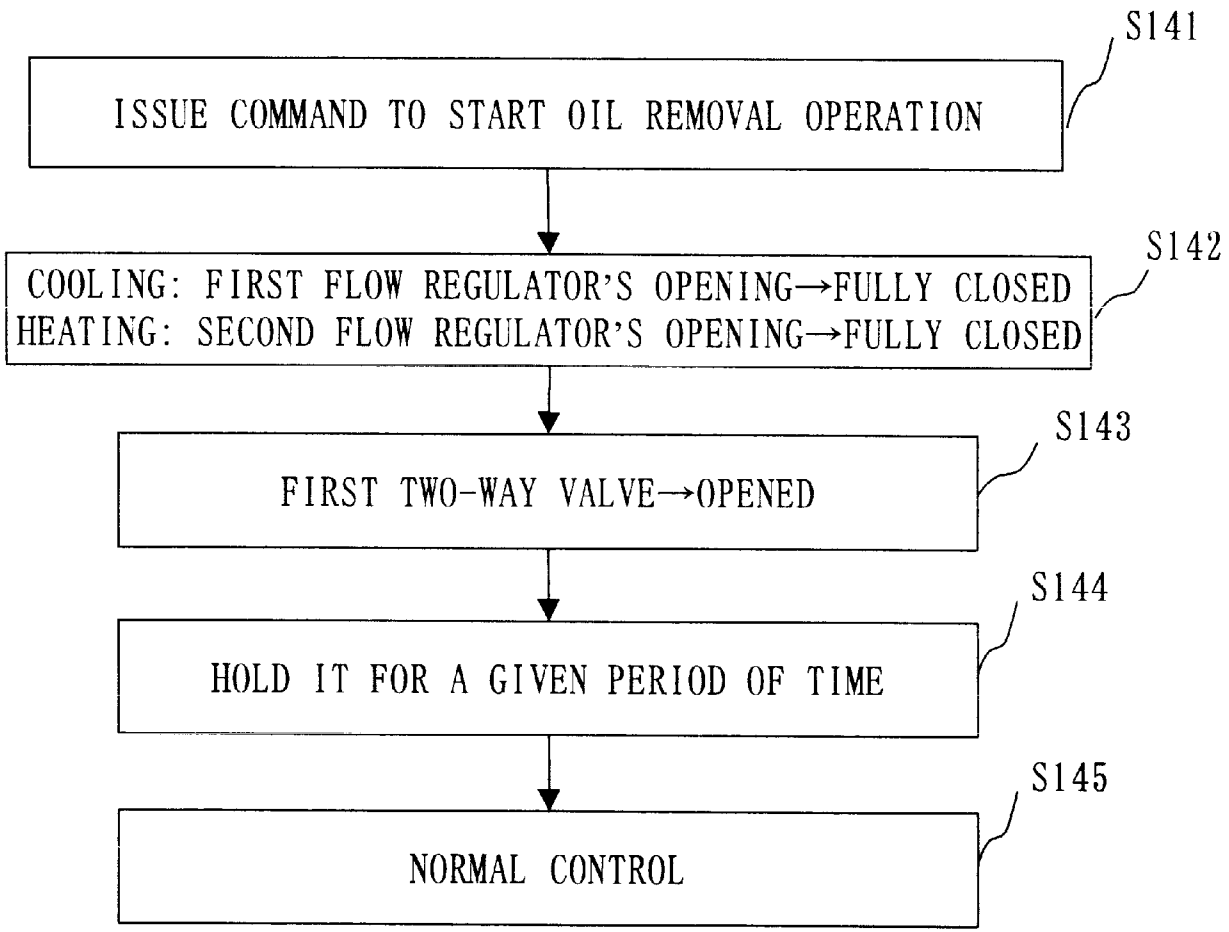
FIG. 23 is a flow chart illustrating an oil removal control for oil reserved from the receiver according to the fifteenth embodiment of the present invention.

FIG. 22 is a block diagram of a refrigeration cycle for an air conditioner, for example, according to a fifteenth embodiment of the present invention. FIG. 23 is a flow chart illustrating an oil removal control procedure of oil reserved in a receiver according to the fifteenth embodiment of the present invention. With referring to FIG. 22, a reference numeral 13 denotes a first non-return valve, which is connected with a pipe diverged from a pipe between the outdoor heat exchanger 5 and the first flow regulator 7*a.* A reference numeral 14 denotes a second non-return valve, which is connected with a pipe unifying pipes diverged from pipes connecting the individual indoor heat exchangers 3*a*–3*c* and the corresponding second flow regulators 8*a*–8*c.* A reference numeral 15 denotes a first two-way valve, which is provided in a pipe diverged from a pipe connecting the first non-return valve 13 and the second non-return valve 14 and connected with the receiver 9 through the top. A reference numeral 20 denotes a controller 20. Other elements shown in FIG. 22 which are the same as or equivalent to the elements of FIG. 1 discussed in the first embodiment are assigned the same reference numerals or signs, and will not be explained here.

The first non-return valve 13 is set in such a manner as to block a flow from the pipe between the outdoor heat exchanger 5 and the flow regulator 7*a* towards the receiver 9 side via the two-way valve 15 in a cooling operation. On the other hand, the second non-return valve 14 is set in such a manner as to block a flow from the indoor heat exchangers towards the receiver 9 side in a heating operation. Then, the opening and closing of the first two-way valve 15 are controlled by the controller 20 in the same manner as the first and second flow regulators.

Furthermore, the connections of the pipes of the refrigeration cycle of FIG. 22 may also be summarized as follows. The refrigeration cycle includes the first two-way valve, the first no-return valve, the second no-return valve and the pipes. Then, the pipes include the first pipe, which connects the outdoor heat exchanger and the first flow regulator, the second pipe, which connects the indoor heat exchanger and the second flow regulator, the third pipe, which branches off from the first pipe and connects with the first no-return valve, the fourth pipe, which branches off from the second pipe and connects with the second no-return valve, the fifth pipe which connects the first no-return valve and the second no-return valve which are arranged in a different direction from each other, and the sixth pipe, which branches off from the fifth pipe and connects with the receiver via the first two-way valve.

A control operation performed by the thus configured refrigeration cycle of the fifteenth embodiment is now discussed with reference to the flow chart of FIG. 23 assuming that a transient return of a large amount of oil causes the stagnation of refrigerating machine oil in the receiver 9 as described in the thirteenth and fourteenth embodiments. Upon issuance of a command to start an oil removal operation for oil stagnating in the receiver 9 (S141), the first flow regulator 7*a* is completely closed (S142) and the first two-way valve 15 is opened (S143) in a cooling operation. Then, this condition is held for a given period (S144). As a result, the receiver 9 is filled with liquid refrigerant, and stagnant weakly soluble oil inside the receiver 9 is discharged through the top of the receiver 9 to the side of the indoor heat exchangers 3*a,* 3*b,* 3*c* via the first two-way valve 15 and the second non-return valve 14. The oil is then returned to the compressor 1 on the suction inlet side via the four-way valve 2. In a heating operation, on the other hand, the second flow regulators 8*a,* 8*b,* 8*c* are completely closed (S142) and the first two-way valve 15 is opened (S143). As a result, the receiver 9 is filled with liquid refrigerant, and stagnant weakly soluble oil inside the receiver 9 is discharged through the top of the receiver 9 to the outdoor heat exchanger 5 side via the first two-way valve 15 and the first non-return valve 13. The oil is then returned to the compressor 1 on the suction inlet side via the four-way valve 2. After the given period, the operation is changed to the normal control (S145).

This embodiment may be summarized as follows. The oil removal controller for oil reserved in the receiver is provided to return oil to the compressor on the suction inlet side. Therefore, even if a transient stagnation of weakly soluble oil occurs in the receiver 9, the compressor is allowed to be free from poor lubrication caused by the exhaustion of oil. Hence, the reliability of the refrigeration cycle may be enhanced.

Embodiment 16

Figure 24:
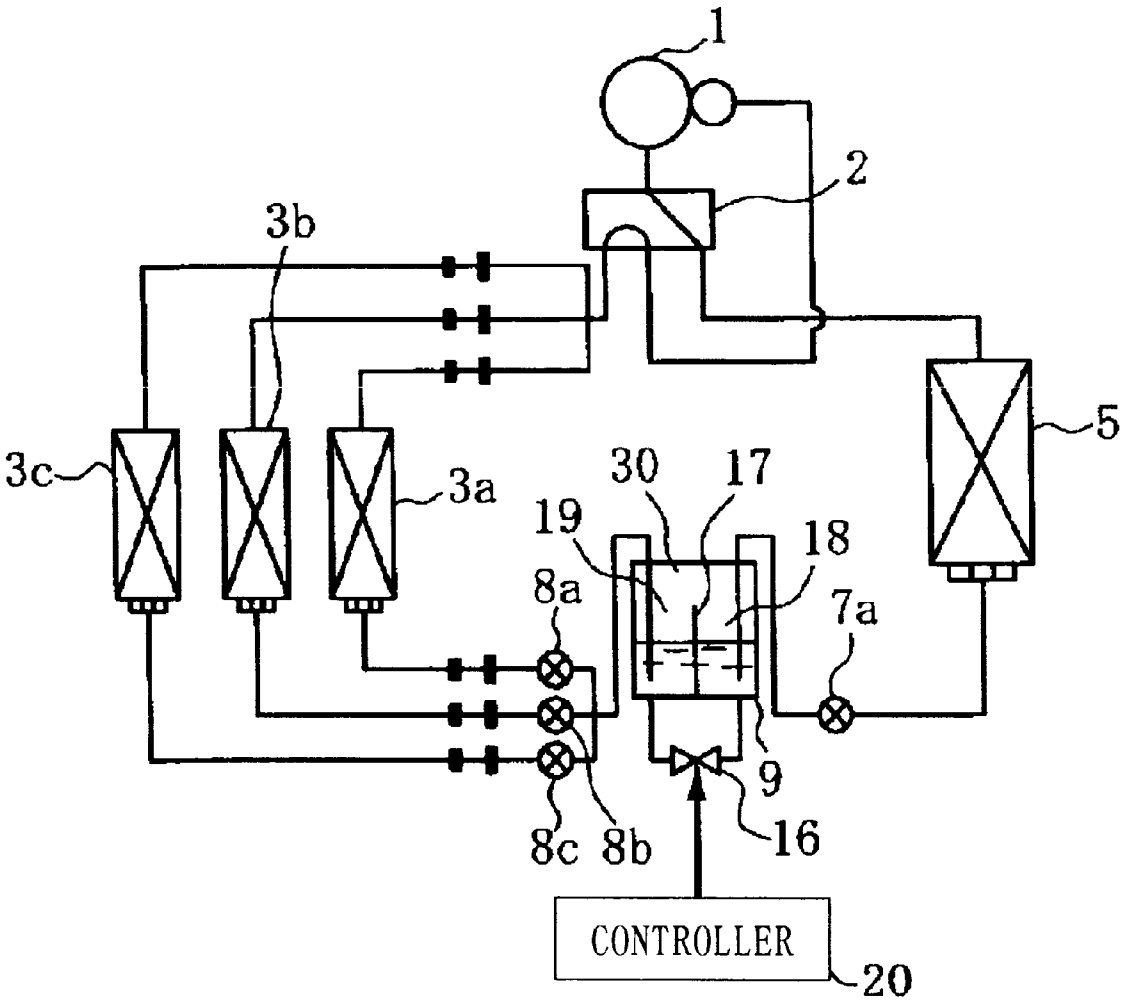
FIG. 24 is a block diagram of a refrigeration cycle for an air conditioner according to a sixteenth embodiment of the present invention.
Figure 25:
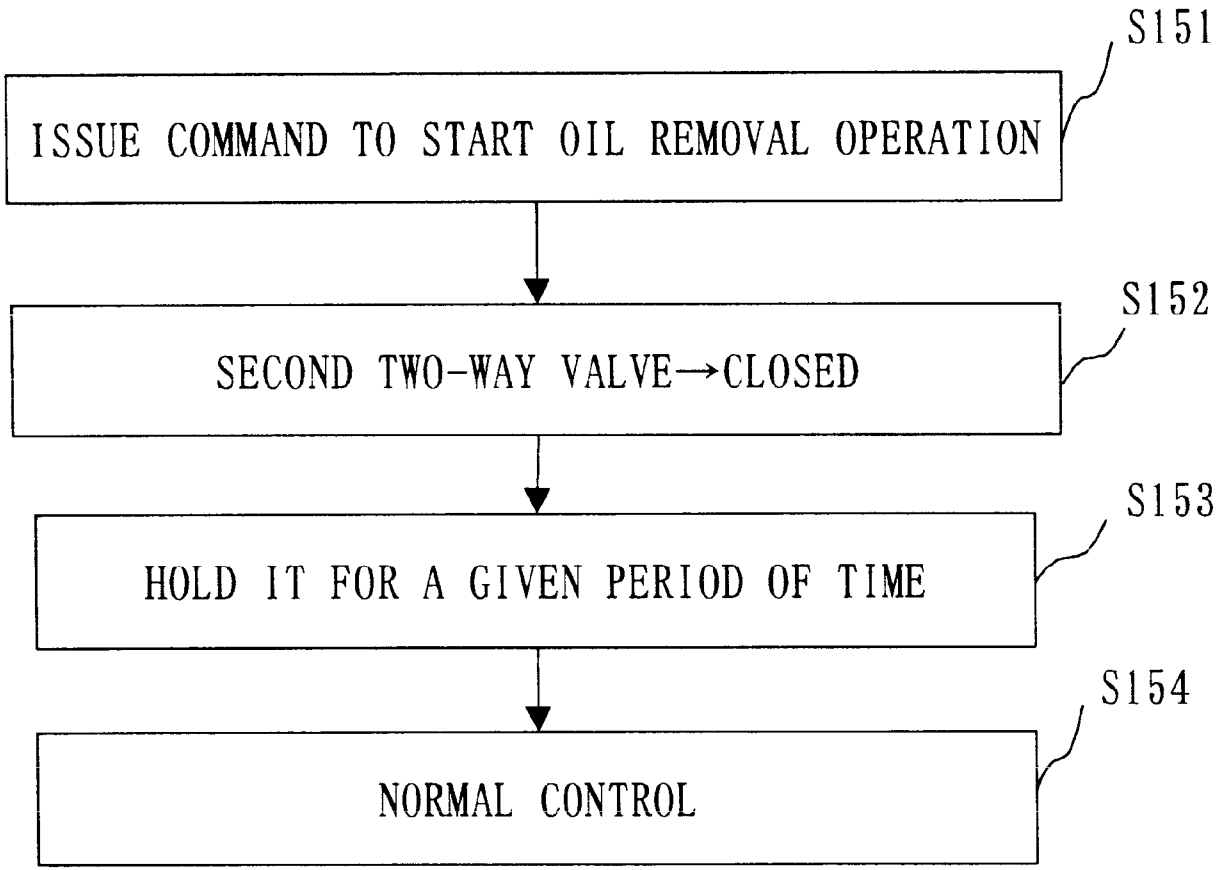
FIG. 25 is a flow chart illustrating an oil removal control for oil reserved from the receiver according to the sixteenth embodiment of the present invention.

FIG. 24 is a block diagram of a refrigeration cycle for an air conditioner, for example, according to a sixteenth embodiment of the present invention. FIG. 25 is a flow chart illustrating an oil removal control procedure for oil reserved in a receiver according to the sixteenth embodiment of the present invention. With referring to FIG. 24, a reference numeral 17 denotes a partition for dividing the inside of the receiver 9 longitudinally into two parts. A reference numeral 18 denotes a first room divided, and a reference numeral 19 denotes a second room divided. A reference numeral 30 denotes a linking part where the first room 18 and the second room 19 are connected at an upper part in the receiver 9. A reference numeral 16 denotes a second two-way valve, which is connected with the receiver 9 at the bottom via pipes. A reference numeral 20 denotes a controller. Other elements shown in FIG. 24 which are the same as or equivalent to the elements of FIG. 1 in the first embodiment are assigned the same reference numerals or signs, and will not be explained here.

The receiver 9 of the refrigeration cycle of FIG. 24 is divided into two rooms longitudinally inside by the partition 17 provided from the bottom upward. In the first room divided 18, a pipe connected with the first flow regulator 7*a* is inserted through the top or ceiling of the receiver 9 and extended to the bottom thereof. In the second room divided 19, a pipe connected with the second flow regulators 8*a,* 8*b,* 8*c* is inserted through the top of the receiver 9 and extended to the bottom. Furthermore, the receiver 9 is provided with the linking part 30 for connecting the first room 18 and the second room 19 in the upper space. Still further, a pipe is provided for connecting the first room 18 and the second room 19 of the receiver 9 at the bottom via the second two-way valve 16.

A control operation performed by the thus configured refrigeration cycle of the sixteenth embodiment is now discussed with reference to the flow chart of FIG. 25 assuming that a transient return of a large amount of oil causes the stagnation of refrigerating machine oil in the receiver 9 as described in the thirteenth and fourteenth embodiments. Upon issuance of a command to start an oil removal operation of refrigerating machine oil (S151), the controller 20 closes the second two-way valve 16, which is normally opened for use (S152), in a cooling operation. This condition is maintained for a given period (S153). As a result, liquid refrigerant and weakly soluble oil in the second room 19 of the receiver 9 flow out to the side of the second flow regulators 8*a,* 8*b,* 8*c*. At the same time, the surface of liquid in the first room 18 is raised by an inflow of liquid refrigerant. Then, separated weakly soluble oil reserved in the first room floating on the surface flows out through the linking part 30 and then falls down to the second room 19 to the bottom. Then, the weakly soluble oil flows out to the side of the second flow regulators 8*a,* 8*b,* 8*c* via the pipe. As a result, the oil returns to the compressor 1 at the suction inlet side by way of the indoor heat exchangers 3*a,* 3*b,* 3*c* and the four-way valve 2. In the same manner, in a heating operation, the second two-way valve 16, which is normally open for use, is closed (S152), which condition is maintained for a given period (S153). As a result, liquid refrigerant and weakly soluble oil reserved in the first room 18 of the receiver 9 flow out to the side of the first regulator 7*a*. At the same time, the surface of liquid in the second room 19 is raised when receiving an inflow of liquid refrigerant. Separated weakly soluble oil floating on the surface of the liquid refrigerant flows through the linking part 30 at the upper part of the receiver 9 and then falls down to the first room 18 to the bottom. Then, the weakly soluble oil flows out to the first flow regulator 7*a* side, and returns to the compressor 1 at the suction inlet side through the outdoor heat exchanger 5 and the four-way valve 2. After performing this operation for a given period, the operation is changed to the normal operation (S154).

This embodiment may be summarized as follows. The oil removal controller for oil reserved in receiver is provided for returning oil to the compressor 1 at the suction inlet side. As a result, if a transient stagnation of weakly soluble oil occurs in the receiver 9, the compressor 1 is allowed to be free from poor lubrication caused by the exhaustion of oil. Hence, the reliability of the refrigeration cycle may be enhanced.

Embodiment 17

A refrigeration cycle according to a seventeenth embodiment of the present invention employs an HFC refrigerant or an HC refrigerant as a refrigerant to be used, and employs an HFC or HC refrigerant and weakly soluble alkyl-benzene oil as a refrigerating machine oil, for example.

The alkyl-benzene oil, for example, is a type of refrigerant machine oil which is weakly soluble in an HFC refrigerant R410A and highly stable. In addition to that, there is little possibility of causing sludge if including foreign matters such as a chloric substance. However, there is a problem in returning oil to the compressor with the oil which is weakly soluble in the HFC refrigerant. With referring back to FIG. 27, the solubility of the HFC refrigerant R410A and alkyl-benzene oil was mentioned. In the case of the conventional refrigeration cycle in which the liquid is reserved in the accumulator, the temperature of residual refrigerant is low and the solubility of those liquids are low. Therefore, the liquid separates and oil floats on the refrigerant layer, which results in a failure in returning oil to the accumulator. However, if residual refrigerant is reserved in the receiver 7 as illustrated in this embodiment, the temperature of residual refrigerant becomes as high as 30 to 45 degrees centigrade, and the solubility of oil becomes 0.8% or higher. As the oil circulation rate is around 0.8% within the normal use of the refrigeration cycle, the oil is not separated. This allows the oil to return to the compressor. Thus, the highly stable weakly soluble oil may be used. Consequently, the reliability of the refrigeration cycle may be enhanced. Still more, an HFC or HC refrigerant whose ozone destruction coefficient is low is allowed to be used. On top of that, an air conditioner is allowed to be provided with a global environment friendly property.

Thus, as aforementioned, according to the present invention, the refrigeration cycle of one of the embodiments connects with the compressor, the outdoor heat exchanger, the flow regulator and the indoor heat exchanger by the pipes to form a loop and contains refrigerating machine oil and a refrigerant therein. The refrigeration cycle includes the control section for controlling the saturation solubility of the refrigerating machine oil of the liquid refrigerant reserved in the refrigeration cycle so that the saturation solubility does not become lower than the oil circulation rate of the refrigerating machine oil in the refrigeration cycle. As a result, the refrigerating machine oil in the residual refrigerant stays dissolved in the reserved liquid refrigerant. Therefore, the refrigerating machine oil does not separate into two layers resulting in the weakly soluble oil stagnated. Furthermore, an accumulator is not provided on the suction inlet side of the compressor. Therefore, the refrigerating machine oil getting a lower temperature and a higher coefficient of viscosity is trapped, which does not prevent the oil from flowing back to the compressor. For that reason, this effects the enhancement of the reliability of the refrigeration cycle.

The refrigeration cycle of another embodiment of the present invention uses the weakly soluble refrigerating machine oil in the refrigerant as the refrigerating machine oil. As a result, in the case of replacing an existing air conditioner, existing extension pipes used in the existing air conditioner are allowed to be reused with no replacement involved. Even if the existing air conditioner uses an HCFC refrigerant+mineral oil, the nature of the weakly soluble oil will not be affected to change by residual substances such as the mineral oil remaining in the existing pipes. Therefore, the reliability of equipment may be guaranteed. Thus, the refrigeration cycle has the effect of saving installation workload and reducing installation costs.

According to the refrigeration cycle of another embodiment of the present invention, the control section includes the receiver placed between the outdoor heat exchanger and the indoor heat exchanger. The receiver reserves the residual refrigerant. The control section also includes at least one of the first flow regulator provided between the pipes connected respectively to the receiver and the outdoor heat exchanger, and the second flow regulator provided between the pipes connected respectively to the receiver and the indoor heat exchanger. This allows a proper control of the temperature or pressure of a liquid refrigerant reserved in the receiver. As a result, the weakly soluble oil stays dissolved in the residual liquid refrigerant reserved in the receiver. Therefore, the weakly soluble oil is not separated in the two layers to stagnate. Hence, the reliability of the refrigeration cycle may be enhanced.

The refrigeration cycle of another embodiment of the present invention further includes the oil circulation rate regulator for regulating the oil circulation rate of the refrigerating machine oil flowing in the refrigeration cycle so that the oil circulation rate becomes equal to or lower than the saturation solubility of the refrigerating machine oil of the liquid refrigerant reserved in the refrigeration cycle. Therefore, if using a compressor which receives a large outflow of oil, it is allowed to hold the oil circulation rate of the weakly soluble oil to be equal to or lower than the saturation solubility of the refrigerating machine oil of the liquid refrigerant reserved in the receiver 9. As a result, weakly soluble oil in the residual refrigerant may stay dissolved in the liquid refrigerant in the receiver 9 without being separated in two layers to stagnate. Therefore, the compressor is not prevented from receiving the oil returning.

The refrigeration cycle of another embodiment of the present invention further includes the first detector for detecting the temperature or pressure of the liquid refrigerant reserved in the receiver, and the controller for controlling the temperature or pressure of the liquid refrigerant reserved in the receiver so that the saturation solubility of the refrigerating machine oil of the liquid refrigerant becomes equal to or higher than the oil circulation rate of the refrigerating machine oil flowing in the refrigeration cycle. As a result, the weakly soluble oil in the residual refrigerant in the receiver 9 is not separated in two layers to stagnate. The weakly soluble oil stays dissolved in the liquid refrigerant in the receiver 9. Thus, the compressor is not prevented from receiving oil returning.

According to the refrigeration cycle of another embodiment of the present invention, the controller controls the first flow regulator or the second flow regulator in such a manner that the saturation solubility of the refrigerating machine oil of the liquid refrigerant, which is calculated based upon the detected temperature, by the first detector, of the liquid refrigerant in the receiver, becomes higher than the oil circulation rate of the refrigerating machine oil flowing in the refrigeration cycle which is calculated based upon an operation frequency of the compressor. As a result, the weakly soluble oil in the residual refrigerant in the receiver 9 is not separated in two layers to stagnate. The weakly soluble oil stays dissolved in the liquid refrigerant in the receiver 9. Thus, the compressor is not prevented from receiving oil returning.

According to the refrigeration cycle of another embodiment of the present invention, for the given period from the start of the compressor, the controller controls the first flow regulator or the second flow regulator so that the temperature of the liquid refrigerant in the receiver detected by the first detector becomes equal to or higher than the given preset temperature. Thus, the temperature of the liquid refrigerant reserved in the receiver is raised to increase the saturation solubility of the refrigerating machine oil. For that reason, the weakly soluble oil is not separated in two layers to stagnate in the receiver and stays dissolved in the liquid refrigerant in the receiver. As a result, the compressor is not prevented from receiving oil returning.

According to the refrigeration cycle of another embodiment of the present invention, the control section further includes the fourth temperature detector for detecting one of the compressor shell temperature and the discharged refrigerant temperature. Then, in the case that the detected temperature by the fourth temperature detector is equal to or lower than the given preset temperature, the controller controls the first flow regulator or the second flow regulator so that the temperature of the liquid refrigerant in the receiver detected by the first detector becomes equal to or higher than the given preset temperature. Thus, if there is wet vapor suction into the compressor and an amount of the refrigerating machine oil flowing out from the compressor is increased, the temperature of the liquid refrigerant reserved in the receiver is raised to increase the saturation solubility of the refrigerating machine oil of the liquid refrigerant. AS a result, the weakly soluble oil is not separated in two layers to stagnate in the receiver. Then, the weakly soluble oil stays dissolved in the liquid refrigerant in the receiver 9. Hence, the oil is not prevented from returning to the compressor.

According to the refrigeration cycle of another embodiment of the present invention, the opening of the flow regulator located on the downstream side of the receiver in the flowing direction of the refrigerant in the refrigeration cycle is held for the given period from the start of the compressor with the opening being narrowed so as to become smaller than the preset normal opening. This may accelerate the accumulation of residual refrigerant in the receiver 9. At the same time, this may stop a large amount of wet vapor suction into the compressor 1 and prevent the weakly soluble oil from floating on the liquid refrigerant layer in the compressor. For that reason, it is prevented that a large amount of the weakly soluble oil flows out from the compressor by a disturbance caused by parts of rotation such as a rotor in the compressor. As a result, the compressor is allowed to be free from poor lubrication caused by the exhaustion of refrigerating machine oil. Hence, the reliability of the refrigeration cycle may be enhanced.

According to the refrigeration cycle of another embodiment of the present invention, the opening of the second flow regulator is reduced to become smaller than the opening of the first flow regulator in a defrost operation. This allows for ease in accumulating the liquid refrigerant in the receiver 9 and stops a large amount of wet vapor suction into the compressor. As a result, the weakly soluble oil may be prevented from floating on the liquid refrigerant layer in the compressor. For that reason, it is prevented that a large amount of the weakly soluble oil flows out from the compressor by a disturbance caused by parts of rotation such as a rotor in the compressor. Thus, the compressor is allowed to be free from poor lubrication caused by the exhaustion of refrigerating machine oil. Hence, the reliability of the refrigeration cycle may be enhanced.

According to the refrigeration cycle of another embodiment of the present invention, the control section further includes the third temperature detector for detecting the temperature of the refrigerant on the outlet side of the outdoor heat exchanger, the four-way valve connected with the compressor via the pipe for changing the flow direction of the refrigerant in the refrigeration cycle, and the controller for controlling the opening of the first flow regulator so that the opening becomes smaller than the normal opening, and then changing the flow direction of the refrigerant by the four-way valve if the detected temperature by the third temperature detector exceeds the given preset temperature in a defrost operation. As a result, an amount of wet vapor suction of the liquid refrigerant in the outdoor heating exchanger 5 into the compressor may be reduced. This may also reduce an amount of wet vapor suction from the receiver 9 to the compressor side. Thus, the weakly soluble oil may be prevented from floating on the liquid refrigerant layer in the compressor. Therefore, it is prevented that a large amount of the weakly soluble oil flows out from the compressor by a disturbance caused by parts of rotation such as a rotor. Consequently, the compressor is allowed to be free from poor lubrication by the exhaustion of oil. Hence, the reliability of the refrigeration cycle may be enhanced.

The refrigeration cycle of another embodiment of the present invention is provided with a multiple number of indoor heat exchangers, being arranged in parallel with each other. Therefore, if the number of operating indoor units is small and an amount of the residual refrigerant is large, the weakly soluble oil stays dissolved in the residual refrigerant in the receiver and is therefore not separated in two layers to stagnate. Still more, as no accumulator is provided at the suction inlet side of the compressor, low-temperature and highly-viscous weakly soluble oil is trapped. As a result, the compressor is not prevented from oil returning. Hence, the reliability of the refrigeration cycle may be enhanced.

The refrigeration cycle of another embodiment of the present invention is provided with the oil removal controller for closing one of the second flow regulators which is connected with an indoor heat exchanger not operating in a heating operation. By condensing the gas refrigerant in the indoor heat exchanger not operating and reserving as the liquid refrigerant in the indoor heat exchanger not operating, the residual liquid refrigerant is removed from the receiver. The weakly soluble oil separated in two layers and floating on the surface of the liquid refrigerant flows out from the receiver through the pipe in the receiver. As a result, the compressor is allowed to receive oil returning. Consequently, the compressor is allowed to be free from poor lubrication caused by the exhaustion of oil. Hence, the reliability of the refrigeration cycle may be enhanced.

According to the refrigeration cycle of another embodiment of the present invention, the refrigerating machine oil reserved in the receiver is removed from the receiver by completely closing the second flow regulator in a heating operation, and completely closing the first flow regulator in a cooling operation. As a result, the compressor is allowed to be free from poor lubrication caused by the exhaustion of the refrigerating machine oil. Hence, the reliability of the refrigeration cycle may be enhanced.

The refrigeration cycle of another embodiment of the present invention further includes the first two-way valve, the first no-return valve, and the second no-return valve. Then, the pipes include the first pipe which connects the outdoor heat exchanger and the first flow regulator, the second pipe which connects the indoor heat exchanger and the second flow regulator, the third pipe which branches off from the first pipe and connects with the first no-return valve, the fourth pipe which branches off from the second pipe and connects with the second no-return valve, the fifth pipe which connects the first no-return valve and the second no-return valve being arranged in a different direction from each other, and the sixth pipe which branches off from the fifth pipe and connects with the receiver via the first two-way valve. Then, the refrigerating machine oil reserved in the receiver is removed by completely opening the flow regulator placed on the upstream side of the receiver in the refrigerant flow direction of the refrigeration cycle and opening the first two-way valve. As a result, the compressor is allowed to be free from poor lubrication caused by the exhaustion of the refrigerating machine oil. Hence, the reliability of the refrigeration cycle may be enhanced.

The refrigeration cycle of another embodiment of the present invention further includes the partition extending upwards from the bottom of the receiver for separating the internal space of the receiver into two rooms, the pipe being put into one of the two rooms almost to the bottom and connected to the first flow regulator, the pipe being put into the other of the two rooms almost to the bottom and connected to the second flow regulator, the second two-way valve provided at the bottom part of the receiver for connecting the two rooms, and the linking part provided at the upper part of the receiver for connecting the two rooms. Then, the refrigerating machine oil reserved in the receiver is removed by closing the second two-way valve. As a result, the compressor is allowed to be free from poor lubrication caused by the exhaustion of the refrigerating machine oil. Hence, the reliability of the refrigeration cycle may be enhanced.

The refrigeration cycle of another embodiment of the present invention further includes the operating period counter for counting the operating period of the compressor. Then, the compressor is controlled to change the operation frequency of the compressor to the given preset operation frequency and then operate for the given period whenever the operating period of the compressor obtained from the operating time counter exceeds the given preset period. As a result, even if the compressor is operated at a low rate using weakly soluble oil, a periodic return of oil to the compressor may be allowed when the set time comes. Consequently, the compressor is allowed to be free from poor lubrication caused by the exhaustion of refrigerating machine oil. Hence, the reliability of the refrigeration cycle may be enhanced.

The refrigeration cycle of another embodiment of the present invention further includes the start controller for operating the compressor with the given preset operation frequency, which is lower than the normal operation frequency, for the given period when the operation of the refrigeration cycle is started. As a result, a disturbance caused by the parts of rotation may be reduced, which may prevent the weakly soluble refrigerating machine oil from flowing out from the compressor. Consequently, the compressor is allowed to be free from poor lubrication caused by the exhaustion of refrigerating machine oil. Hence, the reliability of the refrigeration cycle may be enhanced.

The refrigeration cycle of another embodiment of the present invention further includes the heater for heating the compressor. This may prevent a large amount of the liquid refrigerant from stagnating in the compressor 1 resulting in the weakly soluble oil floating on the liquid refrigerant layer. As a result, a large amount of the weakly soluble oil may be prevented from flowing out from the compressor by a disturbance caused by parts of rotation such as a rotor at the start of the compressor 1. Consequently, the compressor is allowed to be free from poor lubrication caused by the exhaustion of refrigerating machine oil. Hence, the reliability of the refrigeration cycle may be enhanced.

According to the refrigeration cycle of another embodiment of the present invention, the heater includes the outside air temperature detector for detecting an outside air temperature. Then, the heater heats up the compressor if the detected outside air temperature by the outside air temperature detector is lower than the given preset temperature while the compressor is not operated. This may prevent a large amount of the liquid refrigerant from stagnating in the compressor 1 resulting in the weakly soluble oil floating on the liquid refrigerant layer. As a result, a large amount of the weakly soluble oil may be prevented from flowing out from the compressor by a disturbance caused by parts of rotation such as a rotor at a start of the compressor 1. Consequently, the compressor is allowed to be free from poor lubrication caused by the exhaustion of refrigerating machine oil. Hence, the reliability of the refrigeration cycle may be enhanced.

According to the refrigeration cycle of another embodiment of the present invention, the heater includes the non-operation period counter for counting the not-operating period of the compressor. Then, the compressor is heated up if the not-operating period of the compressor is longer than the given preset period. This may prevent a large amount of the liquid refrigerant from stagnating in the compressor resulting in the weakly soluble oil floating on the liquid refrigerant layer. As a result, a large amount of the weakly soluble oil may be prevented from flowing out from the compressor by a disturbance caused by parts of rotation such as a rotor at a start of the compressor 1. Consequently, the compressor is allowed to be free from poor lubrication caused by the exhaustion of refrigerating machine oil. Hence, the reliability of the refrigeration cycle may be enhanced.

The refrigeration cycle of another embodiment of the present invention uses an HFC refrigerant or an HC refrigerant as the refrigerant to be used. Those refrigerants have lower ozone destruction coefficients. Hence, a global environment friendly air conditioner may be provided.

The refrigeration cycle of another embodiment of the present invention uses alkyl-benzene oil as the refrigerating machine oil to be used. Therefore, highly stable weakly soluble oil is allowed to be used. Hence, the reliability of the refrigeration cycle may be enhanced.

Throughout the embodiments of the present invention, it should be noted that the weakly soluble oil means oil the solubility of which is one percent or less than one percent.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for controlling a refrigeration cycle in which a compressor, an outdoor heat exchanger, a flow regulator, and an indoor heat exchanger are connected to each other via pipes to form a loop, the refrigeration cycle containing refrigerating machine oil and a refrigerant, the method comprising the step of:

controlling a saturation solubility of the refrigerating machine oil of a liquid refrigerant reserved in the refrigeration cycle via a control section so that the saturation solubility does not become lower than an oil circulation rate of the refrigerating machine oil in the refrigeration cycle;

positioning a receiver between the outdoor heat exchanger and the indoor heat exchanger in order for the receiver to reserve a residual refrigerant;

providing at least one of a first flow regulator between a first set of pipes which are connected with the receiver and the outdoor heat exchanger;

providing a second flow regulator between a second set of pipes which are connected with the receiver and the indoor heat exchanger;

detecting any one of temperature and pressure of the liquid refrigerant reserved in the receiver via a first detector; and controlling the one of the temperature and the pressure of the liquid refrigerant reserved in the receiver via a controller so that the saturation solubility of the refrigerating machine oil of the liquid refrigerant becomes any one of equal to and higher than the oil circulation rate of the refrigerating machine oil flowing in the refrigeration cycle, wherein the controller controls, during a given period from a start of the compressor, one of the first flow regulator and the second flow regulator so that a detected temperature of the liquid refrigerant in the receiver by the first detector becomes any one of equal to and higher than a given preset temperature.

2. A refrigeration cycle connecting a compressor, an outdoor heat exchanger, a flow regulator, and an indoor heat exchanger via pipes to form a loop, and containing refrigerating machine oil and a refrigerant, the refrigeration cycle comprising:

a control section for controlling a saturation solubility of the refrigerating machine oil of a liquid refrigerant reserved in the refrigeration cycle so that the saturation solubility does not become lower than an oil circulation rate of the refrigerating machine oil in the refrigeration cycle, the control section further including:

a receiver placed between the outdoor heat exchanger and the indoor heat exchanger, the receiver for reserving a residual refrigerant;

at least one of a first flow regulator, provided between a first set of pipes which are connected with the receiver and the outdoor heat exchanger, and a second flow regulator, provided between a second set of pipes which are connected with the receiver and the indoor heat exchanger;

a first detector for detecting one of temperature and pressure of the liquid refrigerant reserved in the receiver; and a controller for controlling the one of the temperature and the pressure of the liquid refrigerant reserved in the receiver so that the saturation solubility of the refrigerating machine oil of the liquid refrigerant becomes any one of equal to and higher than the oil circulation rate of the refrigerating machine oil flowing in the refrigeration cycle, wherein the controller controls, during a given period from a start of the compressor, one of the first flow regulator and the second flow regulator so that a detected temperature of the liquid refrigerant in the receiver by the first detector becomes any one of equal to and higher than a given preset temperature.

3. The refrigeration cycle of claim 2, wherein the refrigerating machine oil is weakly soluble in the refrigerant.

4. The refrigeration cycle of claim 3, wherein the control section includes:

a receiver placed between the outdoor heat exchanger and the indoor heat exchanger, the receiver for reserving a residual refrigerant; and at least one of a first flow regulator provided between pipes which are connected, respectively, with the receiver and the outdoor heat exchanger, and a second flow regulator provided between pipes which are connected, respectively, with the receiver and the indoor heat exchanger.

5. The refrigeration cycle of claim 3, further comprising an operating time counter for counting an operating period of the compressor, wherein the compressor is controlled to change an operation frequency to a given preset operation frequency and then operate for a given period whenever the operating period of the compressor obtained from the operating time counter exceeds a given preset period.

6. The refrigeration cycle of claim 3, further comprising a start controller for operating the compressor with a given preset operation frequency, which is lower than a normal operation frequency, for a given period when an operation of the refrigeration cycle is started.

7. The refrigeration cycle of claim 3, further comprising a heater for heating the compressor.

8. The refrigeration cycle of claim 2, further comprising:

an oil circulation rate regulator for regulating the oil circulation rate of the refrigerating machine oil flowing in the refrigeration cycle so that the oil circulation rate becomes any one of equal to and lower than the saturation solubility of the refrigerating machine oil of the liquid refrigerant reserved in the refrigeration cycle.

9. The refrigeration cycle of claim 2, wherein the controller controls one of the first flow regulator and the second flow regulator so that the saturation solubility of the refrigerating machine oil of the liquid refrigerant in the receiver becomes higher than the oil circulation rate of the refrigerating machine oil flowing in the refrigeration cycle, the saturation solubility being calculated based upon a temperature detected by the first detector and the oil circulation rate being calculated based upon an operation frequency of the compressor.

10. The refrigeration cycle of claim 2, wherein the control section further includes:

a second detector for detecting any one of a compressor shell temperature and a discharged refrigerant temperature; and wherein the controller controls one of the first flow regulator and the second flow regulator, in a case that a detected temperature detected by the second detector is any one of equal to and lower than a given preset temperature, so that a detected temperature of the liquid refrigerant in the receiver, which is detected by the first detector, becomes any one of equal to and higher than the given preset temperature.

11. The refrigeration cycle of claim 10, wherein the control section further includes:

a third detector for detecting a temperature of the refrigerant on an outlet side of the outdoor heat exchanger;

a four-way valve connected with the compressor via a pipe for changing a flow direction of the refrigerant in the refrigeration cycle; and a controller for controlling an opening of the first flow regulator so that the opening becomes smaller than a normal opening, and then changing the flow direction of the refrigerant by the four-way valve if a detected temperature by the third detector exceeds a given preset temperature in a defrost operation.

12. The refrigeration cycle of claim 2, wherein an opening of any one of the first flow regulator and the second flow regulator, the opening being located on a downstream side of the receiver in a flowing direction of the refrigerant in the refrigeration cycle, is held for a given period from a start of the compressor with the opening being narrowed so as to become smaller than a preset normal opening.

13. The refrigeration cycle of claim 2, wherein an opening of the second flow regulator is smaller than an opening of the first flow regulator in a defrost operation.

14. The refrigeration cycle of claim 2, wherein the indoor heat exchanger is a multiple number of indoor heat exchangers which are arranged in parallel with each other.

15. The refrigeration cycle of claim 14, wherein the second flow regulator is a multiple number of second flow regulators which are connected to the multiple number of the indoor heat exchangers, respectively, and wherein the controller closes any one of the multiple number of the second flow regulators which is connected with a particular one of the multiple number of the indoor heat exchangers which is not operating in a heating operation.

16. The refrigeration cycle of claim 2, wherein the refrigerating machine oil reserved in the receiver is removed from the receiver by closing the second flow regulator in a case of a heating operation, and closing the first flow regulator in a case of a cooling operation.

17. The refrigeration cycle of claim 2, further comprising:

a first two-way valve;

a first no-return valve; and a second no-return valve;

wherein the first and second sets of pipes include, a first pipe which connects the outdoor heat exchanger and the first flow regulator, a second pipe which connects the indoor heat exchanger and the second flow regulator;

a third pipe which branches off from the first pipe and connects with the first no-return valve, a fourth pipe which branches off from the second pipe and connects with the second no-return valve, a fifth pipe which connects the first no-return valve and the second no-return valve which are arranged in a different direction from each other, and a sixth pipe which branches off from the fifth pipe and connects with the receiver via the first two-way valve, wherein the refrigerating machine oil reserved in the receiver is removed from the receiver by completely opening the flow regulator placed on an upstream side of the receiver in a refrigerant flow direction of the refrigeration cycle and opening the first two-way valve.

18. The refrigeration cycle of claim 2, further comprising:

a partition extending upwardly from a bottom of the receiver for separating an internal space of the receiver into first and second rooms, a first room pipe being put into the first room almost to the bottom, the first room pipe being connected to the first flow regulator, a second room pipe being put into the second room almost to the bottom, the second room pipe being connected to the second flow regulator, a second two-way valve provided at a bottom part of the receiver for connecting the first and second rooms, and a linking part provided at an upper part of the receiver for connecting the first and second rooms, wherein the refrigerating machine oil reserved in the receiver is removed from the receiver by closing the second two-way valve.

19. The refrigeration cycle of claim 2, further comprising an operating time counter for counting an operating period of the compressor, wherein the compressor is controlled to change an operation frequency to a given preset operation frequency and then operate for a given period whenever the operating period of the compressor obtained from the operating time counter exceeds a given preset period.

20. The refrigeration cycle of claim 2, further comprising a start controller for operating the compressor with a given preset operation frequency, which is lower than a normal operation frequency, for a given period when an operation of the refrigeration cycle is started.

21. The refrigeration cycle of claim 2, further comprising a heater for heating the compressor.

22. The refrigeration cycle of claim 21, wherein the heater includes an outside air temperature detector for detecting an outside air temperature, and wherein the heater heats up the compressor if a detected outside air temperature by the outside air temperature detector is lower than a given preset temperature while the compressor is not operated.

23. The refrigeration cycle of claim 21, wherein the heater includes a non-operation period counter for counting a not-operating period of the compressor, and wherein the compressor is heated up if the not-operating period of the compressor is longer than a given preset period.

24. The refrigeration cycle of claim 2, wherein the refrigerant used is any one of an HRC refrigerant and an HC refrigerant.

25. The refrigeration cycle of claim 2, wherein the refrigerating machine oil used is alkyl-benzene oil.

* * * * *

UNITED STATES PATENT AND TRADEMARK OFFICE

CERTIFICATE OF CORRECTION

PATENT NO. : 6,668,564 B2
DATED : December 30, 2003
INVENTOR(S) : Tetsuji Saikusa et al.

It is certified that error appears in the above-identified patent and that said Letters Patent is hereby corrected as shown below:

Column 2,
Line 52, replace "HRC" with -- HFC --.

Signed and Sealed this

Fourth Day of January, 2005

JON W. DUDAS
*Director of the United States Patent and Trademark Office*